US011725656B2

(12) United States Patent
Tanaka et al.

(10) Patent No.: US 11,725,656 B2
(45) Date of Patent: Aug. 15, 2023

(54) SCROLL COMPRESSOR INCLUDING A FIXED-SIDE FIRST REGION RECEIVING A FORCE WHICH PRESSES A MOVABLE SCROLL AGAINST A MOVEABLE SCROLL AGAINST A FIXED SCROLL

(71) Applicant: DAIKIN INDUSTRIES, LTD., Osaka (JP)

(72) Inventors: Kouji Tanaka, Osaka (JP); Yoshinobu Yosuke, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/836,576

(22) Filed: Jun. 9, 2022

(65) Prior Publication Data

US 2022/0299028 A1 Sep. 22, 2022

Related U.S. Application Data

(63) Continuation of application No. PCT/JP2020/043903, filed on Nov. 25, 2020.

(30) Foreign Application Priority Data

Dec. 12, 2019 (JP) ..... 2019-224675

(51) Int. Cl.
*F04C 18/02* (2006.01)
*F04C 23/00* (2006.01)

(52) U.S. Cl.
CPC ..... *F04C 18/0215* (2013.01); *F04C 18/0269* (2013.01); *F04C 18/0276* (2013.01); (Continued)

(58) Field of Classification Search
CPC ..... F04C 18/0215; F04C 18/0269; F04C 18/0276; F04C 18/0284; F04C 23/008; F04C 2240/30
See application file for complete search history.

(56) References Cited

U.S. PATENT DOCUMENTS 4,548,555 A 10/1985 Hiraga et al.
5,496,161 A 3/1996 Machida et al.
(Continued)

FOREIGN PATENT DOCUMENTS

EP 1262665 A1 * 12/2002 ..... F04C 18/0276
EP 2 497 954 A2 9/2012
(Continued)

OTHER PUBLICATIONS

International Search Report of corresponding PCT Application No. PCT/JP2020/043903 dated Jan. 19, 2021.
(Continued)

*Primary Examiner* — Dominick L Plakkoottam
*Assistant Examiner* — Paul W Thiede
(74) *Attorney, Agent, or Firm* — Global IP Counselors, LLP

(57) ABSTRACT

A scroll compressor includes a fixed scroll and a movable scroll. The fixed-side wrap extends, from a main surface of the fixed-side end plate, along a first direction with a fixed-side dimension set in advance. The movable-side wrap extends, from a main surface of the movable-side end plate, along the first direction with a movable-side dimension set in advance. The fixed and movable side dimensions are set such that a fixed-side first region receives a force that presses the movable scroll against the fixed scroll when the movable scroll is inclined with respect to the fixed scroll. The fixed-side first region includes a distal end surface of a part between 0.0 and 0.5 turns from a fixed-side reference point set in advance and located on an outermost periphery of the fixed-side wrap, and a distal end surface of a part between 1.0 and 1.5 turns from the fixed-side reference point.

14 Claims, 24 Drawing Sheets

(52) U.S. Cl.
CPC ..... *F04C 18/0284* (2013.01); *F04C 23/008* (2013.01); *F04C 2240/30* (2013.01)

(56) References Cited

U.S. PATENT DOCUMENTS

| | | | |
|---|---|---|---|
| 2019/0113033 | A1 | 4/2019 | Sato et al. |
| 2019/0186489 | A1 | 6/2019 | Yosuke et al. |

FOREIGN PATENT DOCUMENTS

| | | | | |
|---|---|---|---|---|
| EP | 3 546 757 | A1 | 10/2019 | |
| JP | 59-68583 | A | 4/1984 | |
| JP | 61-105785 | U | 7/1986 | |
| JP | 9-112456 | A | 5/1997 | |
| JP | 2012-188964 | A | 10/2012 | |
| JP | 2015-78665 | A | 4/2015 | |
| JP | 2016-79873 | A | 5/2016 | |
| JP | 2018-035749 | A | 3/2018 | |
| WO | WO-2021117490 | A1 * | 6/2021 | ..... F04C 18/0215 |

OTHER PUBLICATIONS

International Preliminary Report of corresponding PCT Application No. PCT/JP2020/043903 dated Jun. 23, 2022.
European Search Report of corresponding EP Application No. 20 89 9316.2 dated Dec. 23, 2022.

* cited by examiner

SCROLL COMPRESSOR INCLUDING A FIXED-SIDE FIRST REGION RECEIVING A FORCE WHICH PRESSES A MOVABLE SCROLL AGAINST A MOVEABLE SCROLL AGAINST A FIXED SCROLL

CROSS-REFERENCE TO RELATED APPLICATIONS

This is a continuation of International Application No. PCT/JP2020/043903 filed on Nov. 25, 2020, which claims priority to Japanese Patent Application No. 2019-224675, filed on Dec. 12, 2019. The entire disclosures of these applications are incorporated by reference herein.

BACKGROUND

Technical Field

The present disclosure relates to a scroll compressor used in an air conditioner and the like.

Background Art

JP 2018-35749 A discloses a scroll compressor in which a movable scroll is pressed against a fixed scroll.

SUMMARY

A scroll compressor according to a first aspect includes a fixed scroll having a fixed-side end plate and a fixed-side wrap, and a movable scroll having a movable-side end plate and a movable-side wrap. The fixed-side wrap extends, from a main surface of the fixed-side end plate, along a first direction with a predetermined fixed-side dimension. The movable-side wrap extends, from a main surface of the movable-side end plate facing the main surface of the fixed-side end plate, along the first direction with a predetermined movable-side dimension. The fixed scroll and the movable scroll form a first compression chamber surrounded by an inner peripheral surface of the fixed-side wrap and an outer peripheral surface of the movable-side wrap and form a second compression chamber surrounded by an outer peripheral surface of the fixed-side wrap and an inner peripheral surface of the movable-side wrap. The fixed-side dimension and the movable-side dimension are set such that, when the movable scroll is inclined with respect to the fixed scroll, a fixed-side first region included in a distal end surface of the fixed-side wrap receives a force that presses the movable scroll against the fixed scroll. The fixed-side first region includes a distal end surface of a part between 0.0 turns and 0.5 turns and a distal end surface of a part between 1.0 turns and 1.5 turns from a predetermined fixed-side reference point located on an outermost periphery of the fixed-side wrap.

BRIEF DESCRIPTION OF THE DRAWINGS

FIG. 5A is a diagram illustrating a state when a first compression chamber Sc1 and a second compression chamber Sc2 are formed. FIG. 5A is a diagram illustrating a state in which a phase is advanced by 90° from a state illustrated in FIG. 5D.

DETAILED DESCRIPTION OF EMBODIMENT(S)

An embodiment of a scroll compressor of the present disclosure will be described below with reference to the drawings.

(1) Overall Configuration

A scroll compressor 100 is used in a device including a vapor compression refrigeration cycle using a refrigerant. The scroll compressor 100 is used in, for example, an outdoor unit of an air conditioner and a refrigeration apparatus. The scroll compressor 100 constitutes a part of a refrigerant circuit included in a refrigeration cycle.

The scroll compressor 100 is of a full hermetic compressor. The scroll compressor 100 is a typical low-pressure dome scroll compressor. The scroll compressor 100 sucks a refrigerant flowing through the refrigerant circuit, and compresses and discharges the sucked refrigerant. The refrigerant is, for example, R32.

Figure 1:
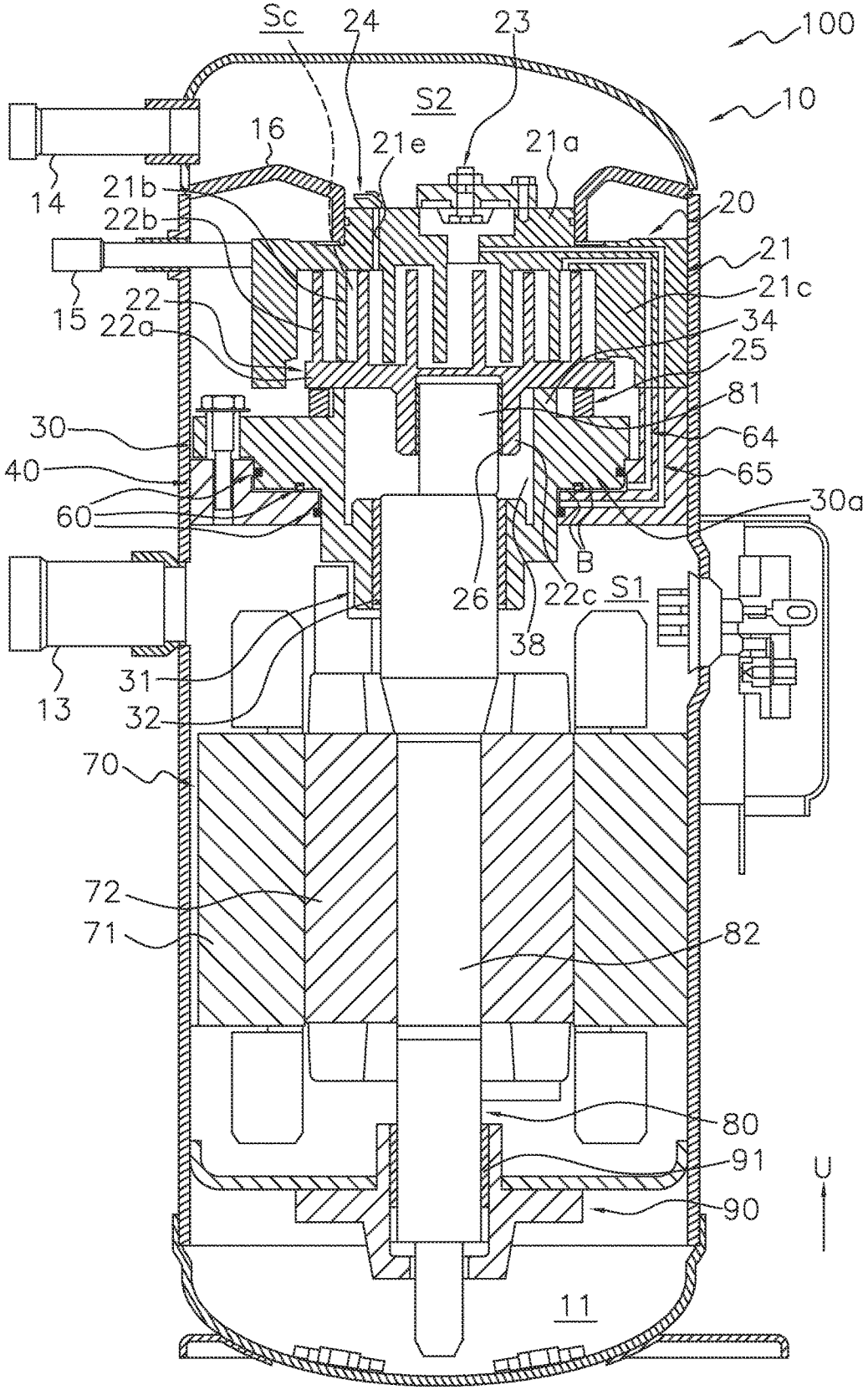
FIG. 1 is a longitudinal sectional view of a scroll compressor 100 according to an embodiment.

As illustrated in FIG. 1, the scroll compressor 100 includes, as main components, a casing 10, a compression mechanism 20, a floating member 30, a housing 40, a seal member 60, a motor 70, a drive shaft 80, and a lower bearing housing 90. In FIG. 1, an arrow U indicates an upper side in a vertical direction.

(2) Detailed Configuration (2-1) Casing 10

The casing 10 has a vertically long cylindrical shape. The casing 10 accommodates members constituting the scroll compressor 100, such as the compression mechanism 20, the floating member 30, the housing 40, the seal member 60, the motor 70, the drive shaft 80, and the lower bearing housing 90.

The compression mechanism 20 is disposed in an upper part of the casing 10. The floating member 30 and the housing 40 are disposed below the compression mechanism 20. The motor 70 is disposed below the housing 40. The lower bearing housing 90 is disposed below the motor 70. The casing 10 has at its bottom an oil reservoir space 11. The oil reservoir space 11 stores a refrigerating machine oil for lubricating, for example, the compression mechanism 20.

The casing 10 has an inner space partitioned by a partition plate 16 into a first space S1 and a second space S2. The first space S1 is a space below the partition plate 16. The second space S2 is a space above the partition plate 16. The partition plate 16 is fixed to the compression mechanism 20 and the casing 10 so as to maintain airtightness between the first space S1 and the second space S2.

The partition plate 16 is a plate-shaped member having an annular shape in plan view. The partition plate 16 has an inner periphery fixed all around to an upper part of a fixed scroll 21 of the compression mechanism 20. The partition plate 16 has an outer periphery fixed all around to an inner surface of the casing 10.

The first space S1 is a space in which the motor 70 is disposed. The first space S1 is a space into which the refrigerant that is not compressed yet by the scroll compressor 100 flows from the refrigerant circuit including the scroll compressor 100. The first space S1 is a space into which a low-pressure refrigerant in the refrigeration cycle flows.

The second space S2 is a space into which the refrigerant to be discharged from the compression mechanism 20 (the refrigerant compressed by the compression mechanism 20) flows. The second space S2 is a space into which a high-pressure refrigerant in the refrigeration cycle flows.

The casing 10 has, attached thereto, a suction pipe 13, a discharge pipe 14, and an injection pipe 15 each causing the inside of the casing 10 to communicate with the outside of the casing 10.

The suction pipe 13 is attached to near a middle of the casing 10 in an up-down direction (vertical direction) of the casing 10. Specifically, the suction pipe 13 is attached at a height position between the housing 40 and the motor 70. The suction pipe 13 causes the outside of the casing 10 to communicate with the first space S1 in the casing 10. The refrigerant that is not compressed yet (the low-pressure refrigerant in the refrigeration cycle) flows into the first space S1 through the suction pipe 13.

The discharge pipe 14 is attached to the upper part of the casing 10 at a height position above the partition plate 16. The discharge pipe 14 causes the outside of the casing to communicate with the second space S2 in the casing 10. The refrigerant compressed by the compression mechanism 20 and flowing into the second space S2 (the high-pressure refrigerant in the refrigeration cycle) flows out of the scroll compressor 100 through the discharge pipe 14.

The injection pipe 15 is attached to the upper part of the casing 10 at a height position below the partition plate 16. The injection pipe 15 is attached so as to penetrate the casing 10. The injection pipe 15 has an end located in the casing 10 and connected to the fixed scroll 21 of the compression mechanism 20 as illustrated in FIG. 1. The injection pipe communicates with a compression chamber Sc being in the midstream of compression in the compression mechanism 20 via a passage (not illustrated) on the fixed scroll 21. An intermediate-pressure refrigerant (refrigerant having an intermediate pressure between a low pressure and a high pressure in the refrigeration cycle) is supplied to the compression chambers Sc being in the midstream of compression through the injection pipe 15 from the refrigerant circuit including the scroll compressor 100.

(2-2) Compression Mechanism 20

The compression mechanism 20 includes the fixed scroll 21 and a movable scroll 22, as main components. The fixed scroll 21 and the movable scroll 22 are combined with each other to form the compression chamber Sc. The compression mechanism 20 compresses the refrigerant in the compression chamber Sc and discharges the compressed refrigerant. The compression mechanism 20 has a symmetrical wrap structure as described later.

(2-2-1) Fixed Scroll 21

The fixed scroll 21 is placed on the housing 40, as shown in FIG. 1. The fixed scroll 21 and the housing 40 are fastened to each other with fixing means such as a bolt (not illustrated).

The fixed scroll 21 includes a disk-shaped fixed-side end plate 21*a*, a spiral fixed-side wrap 21*b*, and a peripheral edge 21*c*. The fixed-side wrap 21*b* and the peripheral edge 21*c* extend from a front surface (lower surface) of the fixed-side end plate 21*a* toward the movable scroll 22 (downward). When the fixed scroll 21 is viewed from below, the fixed-side wrap 21*b* has a spiral shape (an involute shape) spiraling from a region near a center of the fixed-side end plate 21*a* toward an outer periphery of the fixed-side end plate 21*a*. The peripheral edge 21*c* has a cylindrical shape. The peripheral edge 21*c* is disposed on the outer periphery of the fixed-side end plate 21*a* so as to surround the fixed-side wrap 21*b*.

During an operation of the scroll compressor 100, when the movable scroll 22 revolves relative to the fixed scroll 21, the refrigerant having flown from the first space S1 into the compression chamber Sc (the low-pressure refrigerant in the refrigeration cycle) is compressed as moving toward the innermost (central) compression chamber Sc. The fixed-side end plate 21*a* has at its approximately center a discharge port 21*d* through which the refrigerant compressed in the compression chamber Sc is discharged. The discharge port 21*d* penetrates the fixed-side end plate 21*a* in a thickness direction of the fixed-side end plate 21*a* (up-down direction). The discharge port 21*d* communicates with the innermost compression chamber Sc. A discharge valve 23 that opens and closes the discharge port 21*d* is attached above the fixed-side end plate 21*a*. When a pressure in the innermost compression chamber Sc communicating with the discharge port 21*d* is higher than a pressure in the space above the discharge valve 23 (the second space S2) by a predetermined value or more, the discharge valve 23 is opened to cause the refrigerant to flow into the second space S2 through the discharge port 21*d*.

The fixed-side end plate 21*a* has a relief hole 21*e* on an outer periphery of the discharge port 21*d* of the fixed-side end plate 21*a*. The relief hole 21*e* penetrates the fixed-side end plate 21*a* in the thickness direction of the fixed-side end plate 21*a*. The relief hole 21*e* communicates with the compression chamber Sc closer to the outer periphery than the innermost compression chamber Sc communicating with the discharge port 21*d*. The relief hole 21*e* communicates with the compression chamber Sc being in the midstream of compression in the compression mechanism 20. The fixed-side end plate 21*a* may have a plurality of the relief holes 21*e*. A relief valve 24 that opens and closes the relief hole 21*e* is attached above the fixed-side end plate 21*a*. When a pressure in the compression chamber Sc communicating with the relief hole 21*e* is higher than a pressure in the space above the relief valve 24 by a predetermined value or more, the relief valve 24 is opened to cause the refrigerant to flow into the second space S2 through the relief hole 21*e*.

(2-2-2) Movable Scroll 22

The movable scroll 22 includes a disk-shaped movable-side end plate 22*a*, a spiral movable-side wrap 22*b*, and a cylindrical boss 22*c*. The movable-side wrap 22*b* extends from a front surface (upper surface) of the movable-side end plate 22*a* toward the fixed scroll 21. The boss 22*c* extends downward from a rear surface (lower surface) of the movable-side end plate 22*a*. When the movable scroll 22 is viewed from above, the movable-side wrap 22*b* has a spiral shape (involute shape) from a region near a center of the movable-side end plate 22*a* toward an outer periphery of the movable-side end plate 22*a*.

The fixed-side wrap 21*b* of the fixed scroll 21 is combined with the movable-side wrap 22*b* of the movable scroll 22 to form the compression chambers Sc. The fixed scroll 21 and the movable scroll 22 are combined such that the front surface (lower surface) of the fixed-side end plate 21*a* and the front surface (upper surface) of the movable-side end plate 22*a* face each other. This configuration constitutes the compression chamber Sc surrounded by the fixed-side end plate 21*a*, the fixed-side wrap 21*b*, the movable-side wrap 22*b*, and the movable-side end plate 22*a*.

In the compression mechanism 20 having a symmetrical wrap structure, the compression chamber Sc surrounded by an outer peripheral surface of the movable-side wrap 22*b* and an inner peripheral surface of the fixed-side wrap 21*b* (first compression chamber Sc1 in FIGS. 5A to 5D) and the compression chamber Sc surrounded by an inner peripheral surface of the movable-side wrap 22*b* and an outer peripheral surface of the fixed-side wrap 21*b* (second compression chamber Sc2 in FIGS. 5A to 5D) are in point-symmetry when viewed along the vertical direction (first direction). A winding end angle of the movable-side wrap 22*b* is the same as a winding end angle of the fixed-side wrap 21*b*. The winding end angle of the movable-side wrap 22*b* is an angle in a spiral direction (peripheral direction) of an end (winding end) on the outer periphery of the movable-side end plate 22*a* when an end (winding start) at the center of the movable-side end plate 22*a* is a base point (0°). The winding end angle of the fixed-side wrap 21*b* is an angle in a spiral direction (peripheral direction) of an end (winding end) on the outer periphery of the fixed-side end plate 21*a* when an end (winding start) at the center of the fixed-side end plate 21*a* is a base point (0°). In the compression mechanism 20 having a symmetrical wrap structure, the refrigerant is compressed in the first compression chamber Sc1 and in the second compression chamber Sc2 at the same timing. The fixed scroll 21 and the movable scroll 22 will be described in detail later.

The movable-side end plate 22*a* is disposed above the floating member 30. During the operation of the scroll compressor 100, the floating member 30 is pushed toward the movable scroll 22 by a pressure in a back pressure space B formed below the floating member 30. Thus, a pressing part 34 in an upper part of the floating member 30 comes into contact with the rear surface (lower surface) of the movable-side end plate 22*a*, and then the floating member 30 presses the movable scroll 22 against the fixed scroll 21. A force of the floating member 30 pressing the movable scroll 22 against the fixed scroll 21 causes the movable scroll 22 to be in close contact with the fixed scroll 21. This suppresses leakage of the refrigerant from a gap between a tip (distal end surface) of the fixed-side wrap 21*b* and a bottom surface (main surface in contact with the tip) of the movable-side end plate 22*a* and a gap between a tip of the movable-side wrap 22*b* and a bottom surface of the fixed-side end plate 21*a*.

Figure 2:
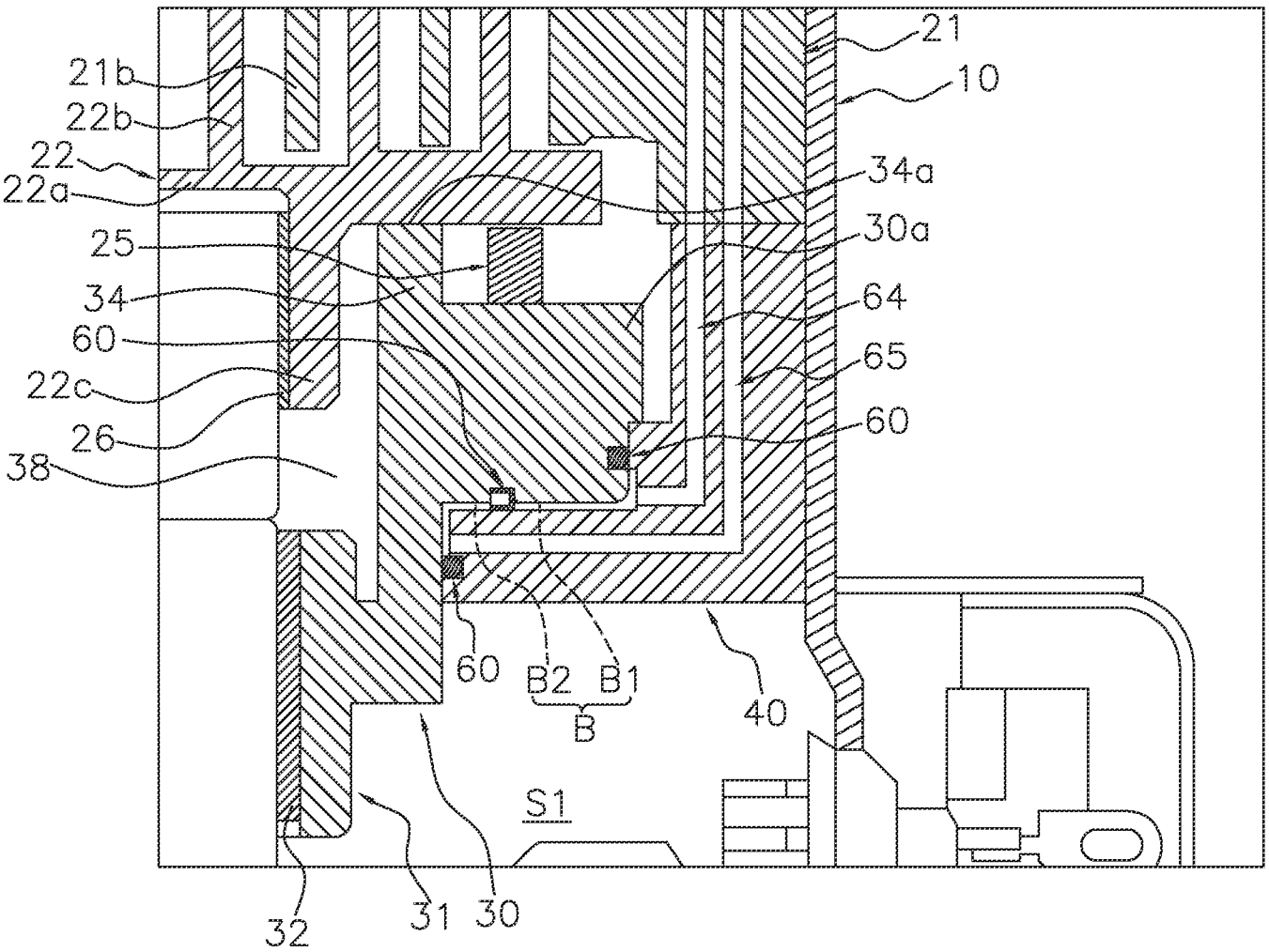
FIG. 2 is an enlarged view of a floating member 30 and its vicinity in the scroll compressor 100 illustrated in FIG. 1.

The back pressure space B is a space formed between the floating member 30 and the housing 40. As illustrated in FIG. 2, the back pressure space B is formed mainly on a rear face of the floating member 30 (below the floating member 30). The refrigerant in the compression chambers Sc of the compression mechanism 20 is guided to the back pressure space B. A region between the back pressure space B and the first space S1 around the back pressure space B is sealed. During the operation of the scroll compressor 100, the pressure in the back pressure space B is higher than a pressure in the first space S1.

An Oldham's coupling 25 is disposed between the movable scroll 22 and the floating member 30. The Oldham's coupling 25 slidably engages both the movable scroll 22 and the floating member 30. The Oldham's coupling 25 restricts rotation of the movable scroll 22 and causes the movable scroll 22 to revolve relative to the fixed scroll 21.

The boss 22*c* is disposed in an eccentric part space 38 surrounded by an inner surface of the floating member 30. A bearing metal 26 is disposed inside the boss 22*c*. The bearing metal 26 is press-fitted and fixed inside the boss 22*c*, for example. Into the bearing metal 26, an eccentric part 81 of the drive shaft 80 is inserted. The eccentric part 81 is inserted into the bearing metal 26 to couple the movable scroll 22 and the drive shaft 80 to each other.

(2-3) Floating Member 30

The floating member 30 is disposed on a rear surface of the movable scroll 22 (opposite to where the fixed scroll 21 is disposed). The floating member 30 is pushed toward the movable scroll 22 by the pressure in the back pressure space B to press the movable scroll 22 against the fixed scroll 21. A part of the floating member 30 functions as a bearing that supports the drive shaft 80.

The floating member 30 includes a cylindrical part 30*a*, the pressing part 34, and an upper bearing housing 31, as main components.

The cylindrical part 30*a* forms the eccentric part space 38 surrounded by an inner surface of the cylindrical part 30*a*. The boss 22*c* of the movable scroll 22 is disposed in the eccentric part space 38.

The pressing part 34 is a cylindrical member extending from an upper end of the cylindrical part 30*a* toward the movable scroll 22. As illustration in FIG. 2, the pressing part 34 has, on its upper end, a thrust surface 34*a* facing the rear surface of the movable-side end plate 22*a* of the movable scroll 22. The thrust surface 34*a* has an annular shape in plan view. When the floating member 30 is pushed toward the movable scroll 22 by the pressure in the back pressure space B, the thrust surface 34*a* comes into contact with the rear surface of the movable-side end plate 22*a*, and presses the movable scroll 22 against the fixed scroll 21.

The upper bearing housing 31 is a member disposed below the cylindrical part 30*a* (below the eccentric part space 38). A bearing metal 32 is disposed in the upper bearing housing 31. The bearing metal 32 is press-fitted and fixed inside the upper bearing housing 31, for example. The bearing metal 32 rotatably supports a main shaft 82 of the drive shaft 80.

(2-4) Housing 40

The housing 40 is a substantially cylindrical member disposed below the fixed scroll 21 and the floating member 30. The housing 40 supports the floating member 30. The back pressure space B is formed between the housing 40 and the floating member 30. The housing 40 is attached to the inner surface of the casing 10 by press fitting, for example.

(2-5) Seal Member 60

The seal member 60 is a member that forms the back pressure space B between the floating member 30 and the housing 40. The seal member 60 is, for example, a gasket such as an O-ring. As illustrated in FIG. 2, the seal member 60 partitions the back pressure space B into a first chamber B1 and a second chamber B2. Each of the first chamber B1 and the second chamber B2 is a substantially annular space in plan view. The second chamber B2 is disposed inward with respect to the first chamber B1. The first chamber B1 is larger in area than the second chamber B2 in plan view.

The first chamber B1 communicates with the compression chamber Sc being in the midstream of compression, via a first flow path 64. The first flow path 64 is a refrigerant flow path for guiding into the first chamber B1 the refrigerant being in the midstream of compression in the compression mechanism 20 (intermediate-pressure refrigerant). The first flow path 64 is formed in the fixed scroll 21 and the housing 40.

The second chamber B2 communicates with the discharge port 21*d* of the fixed scroll 21 via a second flow path 65. The second flow path 65 is a refrigerant flow path for guiding into the second chamber B2 the refrigerant discharged from the compression mechanism 20 (high-pressure refrigerant). The second flow path 65 is formed in the fixed scroll 21 and the housing 40.

During the operation of the scroll compressor 100, a pressure in the second chamber B2 is higher than a pressure in the first chamber B1. Since the first chamber B1 is larger in area than the second chamber B2 in plan view, a pressing force of the movable scroll 22 against the fixed scroll 21 by the pressure in the back pressure space B is less prone to become excessively large. Since the second chamber B2 is disposed inward with respect to the first chamber B1, it is easy to secure a balance between a force by which the movable scroll 22 is pushed downward by the pressure of the compression chamber Sc and a force by which the movable scroll 22 is pushed upward by the floating member 30.

(2-6) Motor 70

The motor 70 drives the movable scroll 22. The motor 70 includes a stator 71 and a rotor 72. The stator 71 is an annular member fixed to the inner surface of the casing 10. The rotor 72 is a cylindrical member disposed inside the stator 71. Between an inner peripheral surface of the stator 71 and an outer peripheral surface of the rotor 72, a slight gap (air gap) is formed.

The drive shaft 80 penetrates the rotor 72 along an axial direction of the rotor 72. The rotor 72 is coupled to the movable scroll 22 via the drive shaft 80. When the rotor 72 rotates, the motor 70 drives the movable scroll 22 to cause the movable scroll 22 to revolve relative to the fixed scroll 21.

(2-7) Drive Shaft 80

The drive shaft 80 couples the rotor 72 of the motor 70 to the movable scroll 22 of the compression mechanism 20. The drive shaft 80 extends in the up-down direction. The drive shaft 80 transmits a driving force of the motor 70 to the movable scroll 22.

The drive shaft 80 includes the eccentric part 81 and the main shaft 82, as main components.

The eccentric part 81 is disposed above the main shaft 82. The eccentric part 81 has a center axis that is eccentric relative to a center axis of the main shaft 82. The eccentric part 81 is coupled to the bearing metal 26 disposed inside the boss 22*c* of the movable scroll 22.

The main shaft 82 is rotatably supported by the bearing metal 32 disposed in the upper bearing housing 31 of the floating member 30 and a bearing metal 91 disposed in the lower bearing housing 90. The main shaft 82 is coupled to the rotor 72 of the motor 70 at a position between the upper bearing housing 31 and the lower bearing housing 90. The main shaft 82 extends in the up-down direction.

An oil passage, which is not illustrated, is formed inside the drive shaft 80. The oil passage includes a main passage (not illustrated) and a branch passage (not illustrated). The main passage extends from a lower end to an upper end of the drive shaft 80 in an axial direction of the drive shaft 80. The branch passage branches off the main passage and extends in a radial direction of the drive shaft 80. The refrigerating machine oil in the oil reservoir space 11 is pumped up by a pump (not illustrated) disposed on the lower end of the drive shaft 80, and then is supplied to, for example, sliding parts between the drive shaft 80 and the bearing metals 26, 32, and 91, and a sliding part of the compression mechanism 20, via the oil passage.

(2-8) Lower Bearing Housing 90

The lower bearing housing 90 is fixed to the inner surface of the casing 10. The lower bearing housing 90 is disposed below the motor 70. The bearing metal 91 is disposed in the lower bearing housing 90. The bearing metal 91 is press-fitted and fixed inside the lower bearing housing 90, for example. The main shaft 82 of the drive shaft 80 passes through the bearing metal 91. The bearing metal 91 rotatably supports a lower part of the main shaft 82 of the drive shaft 80.

(3) Operation of Scroll Compressor 100

The operation of the scroll compressor 100 in a normal state will be described. The normal state is a state in which a pressure of the refrigerant to be discharged through the discharge port 21*d* of the compression mechanism 20 is higher than the pressure in the compression chamber Sc being in the midstream of compression.

When the motor 70 is driven, the rotor 72 rotates, and the drive shaft 80 coupled to the rotor 72 also rotates. When the drive shaft 80 rotates, the movable scroll 22 does not rotate but revolves relative to the fixed scroll 21, by the Oldham's coupling 25. The low-pressure refrigerant having flown into the first space S1 through the suction pipe 13 is sucked into the compression chamber Sc close to the peripheral edge of the compression mechanism 20, via a refrigerant passage (not illustrated) in the housing 40. As the movable scroll 22 revolves, the first space S1 and the compression chamber Sc do not communicate with each other, the compression chamber Sc decreases in volume, and the pressure in the compression chamber Sc rises. The refrigerant is injected into the compression chamber Sc being in the midstream of compression, through the injection pipe 15. The pressure of the refrigerant rises as the refrigerant moves from the compression chamber Sc close to the peripheral edge (outer side), to the compression chamber Sc close to the center (inner side). The high-pressure refrigerant in the refrigeration cycle is finally obtained. The refrigerant compressed by the compression mechanism 20 is discharged from the compression mechanism 20 to the second space S2 through the discharge port 21*d* of the fixed-side end plate 21*a*. The high-pressure refrigerant in the second space S2 is discharged through the discharge pipe 14.

(4) Detailed Configurations of Fixed Scroll 21 and Movable Scroll 22

Figure 3:
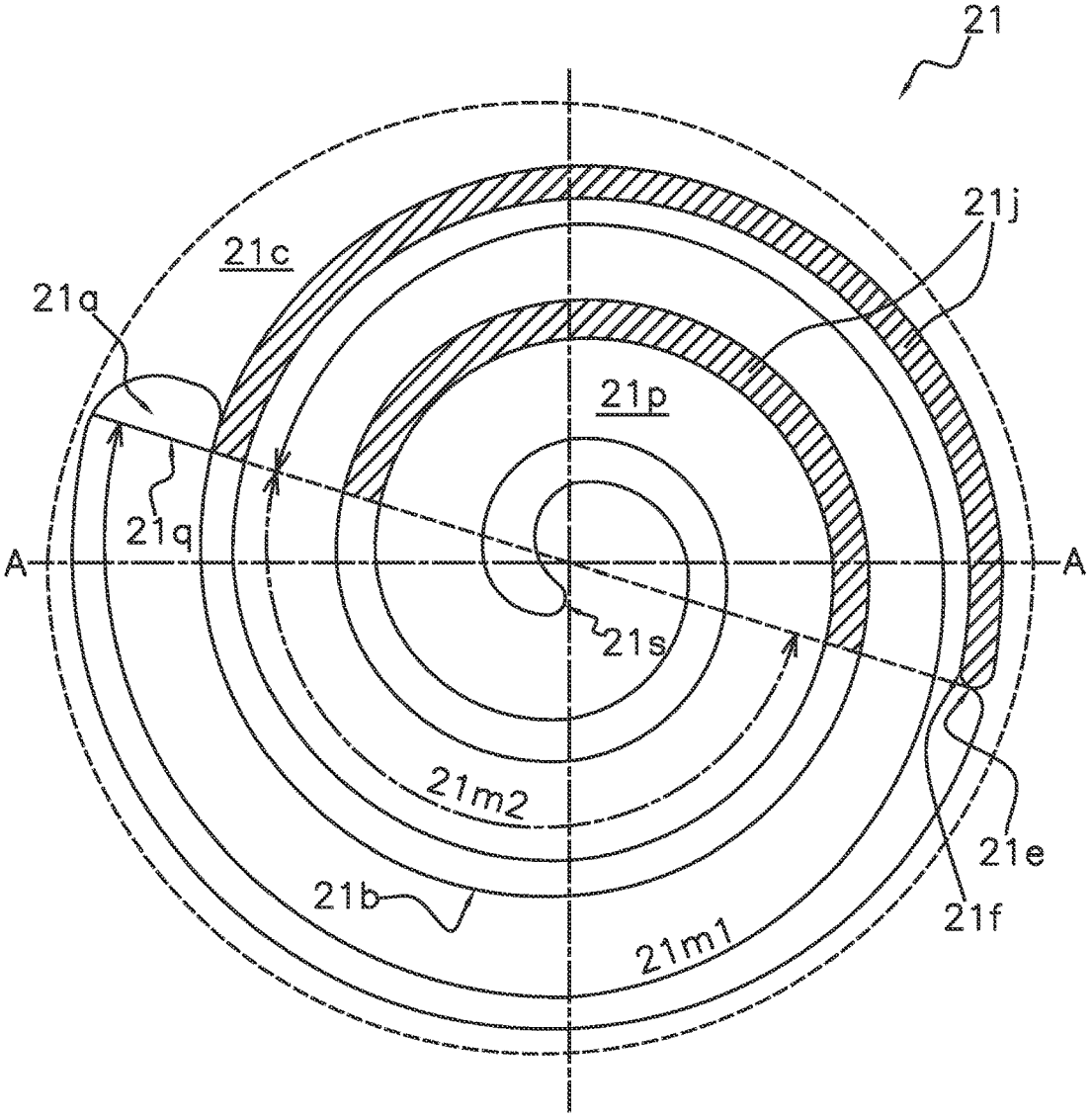
FIG. 3 is a plan view of a fixed scroll 21 in FIG. 1.

As illustrated in FIG. 3, the fixed-side wrap 21*b*, in plan view, has a spiral shape from a winding start 21*s*, which is an end at the center of the fixed-side end plate 21*a*, to a winding end 21*e*, which is an end on the outer periphery. The fixed-side wrap 21*b* extends, from a main surface 21*p* (lower surface) of the fixed-side end plate 21*a*, along the vertical direction (first direction) with a predetermined fixed-side dimension. The fixed-side dimension is a dimension in the vertical direction of the fixed-side wrap 21*b* from the main surface 21*p* of the fixed-side end plate 21*a* coupled to a lower end of the fixed-side wrap 21*b* to the distal end surface of the fixed-side wrap 21*b*. The fixed-side dimension is not constant from the winding start 21*s* to the winding end 21*e*. A height position of the main surface 21*p* of the fixed-side end plate 21*a* may be different on both sides of the fixed-side wrap 21*b*.

Figure 4:
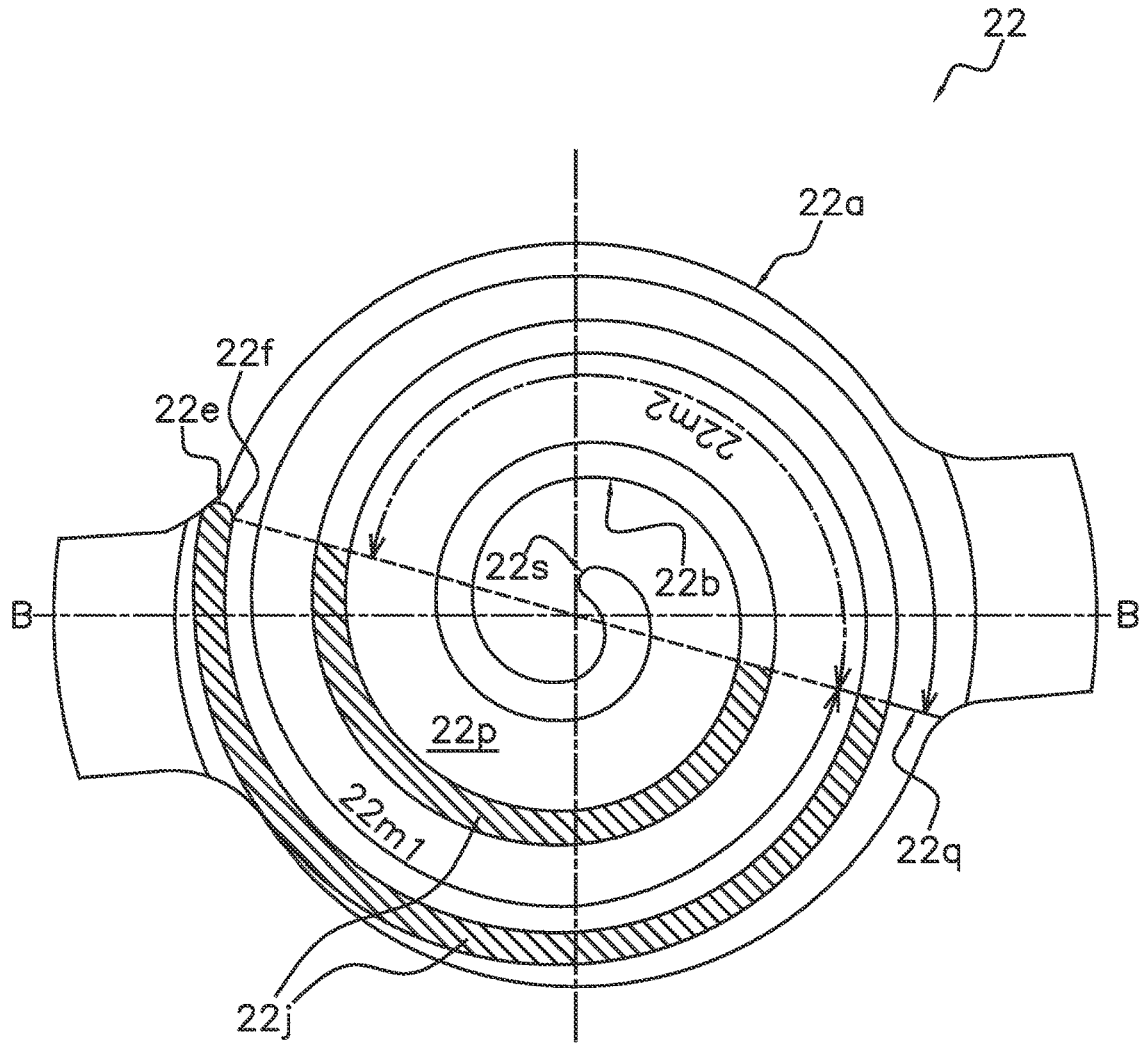
FIG. 4 is a plan view of a movable scroll 22 in FIG. 1.

As illustrated in FIG. 4, the movable-side wrap 22*b*, in plan view, has a spiral shape from a winding start 22*s* as an end at the center of the movable-side end plate 22*a* to a winding end 22*e* as an end on the outer periphery. The movable-side wrap 22*b* extends, from a main surface 22*p* (upper surface) of the movable-side end plate 22*a* facing the main surface 21*p* (lower surface) of the fixed-side end plate 21*a*, along the vertical direction with a predetermined movable-side dimension. The movable-side dimension is a dimension in the vertical direction of the movable-side wrap 22*b* from the main surface 22*p* of the movable-side end plate 22*a* coupled to a lower end of the movable-side wrap 22*b* to the distal end surface of the movable-side wrap 22*b*. The movable-side dimension is not constant from the winding start 22*s* to the winding end 22*e*. A height position of the main surface 22*p* of the movable-side end plate 22*a* may be different on both sides of the movable-side wrap 22*b*.

FIGS. 5A to 5D illustrate transition of a state in which the movable scroll 22 revolves one turn (360°) relative to the fixed scroll 21. FIGS. 5A to 5D each illustrate a state in which a phase is advanced by 90° from a previous state. In other words, FIGS. 5A to 5D each illustrate a state in which the movable scroll 22 has revolved by 90° from the previous state. In FIGS. 5A to 5D, the fixed-side wrap 21*b* and the movable-side wrap 22*b* are indicated by hatched regions.

Figure 5A:
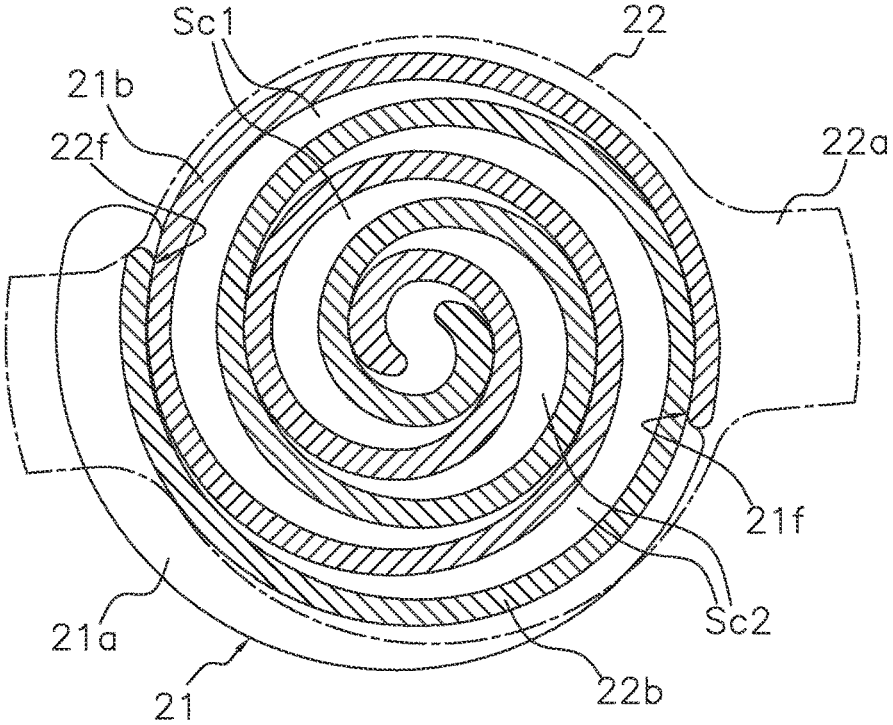
FIG. 5A is a diagram illustrating a state in which the fixed scroll 21 and the movable scroll 22 in FIG. 1 meshing with each other as viewed from above with a fixed-side end plate 21*a* removed.
Figure 5B:
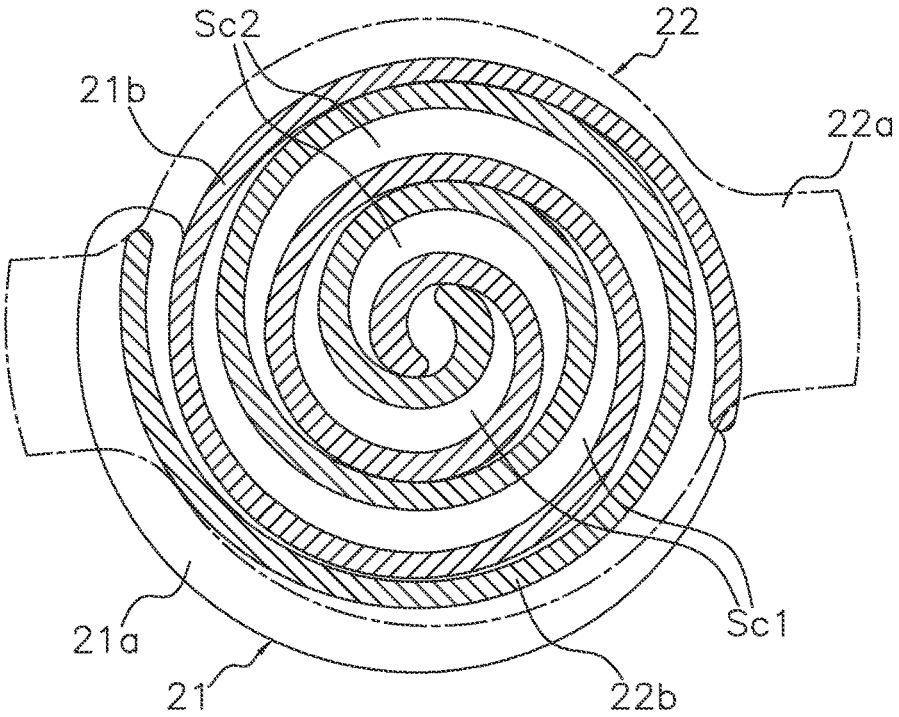
FIG. 5B is a diagram illustrating a state in which the phase is advanced by 90° from the state illustrated in FIG. 5A.
Figure 5C:
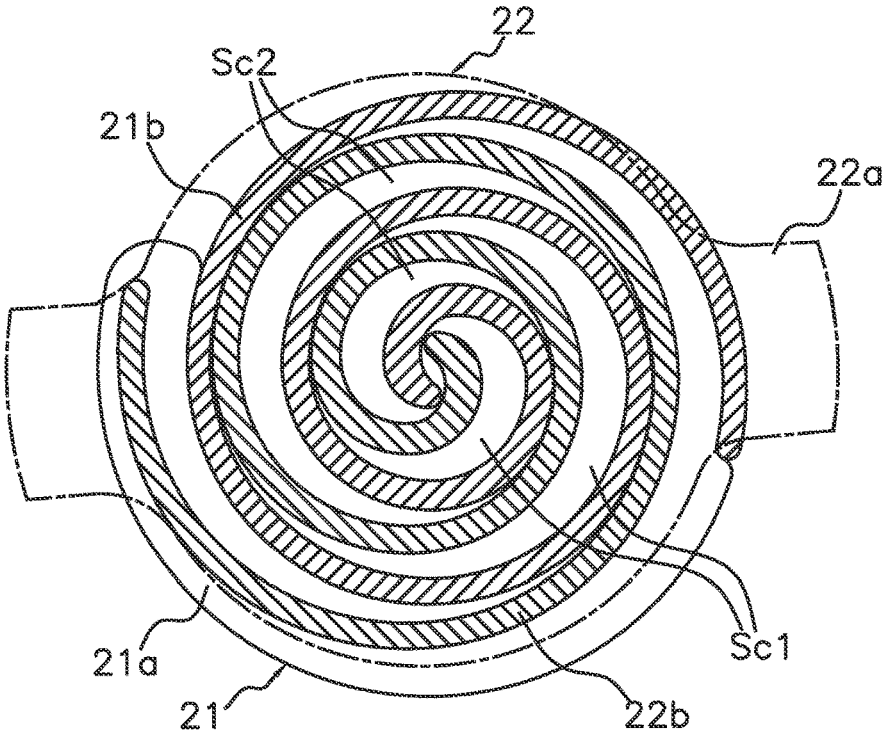
FIG. 5C is a diagram illustrating a state in which the phase is advanced by 90° from the state illustrated in FIG. 5B.
Figure 5D:
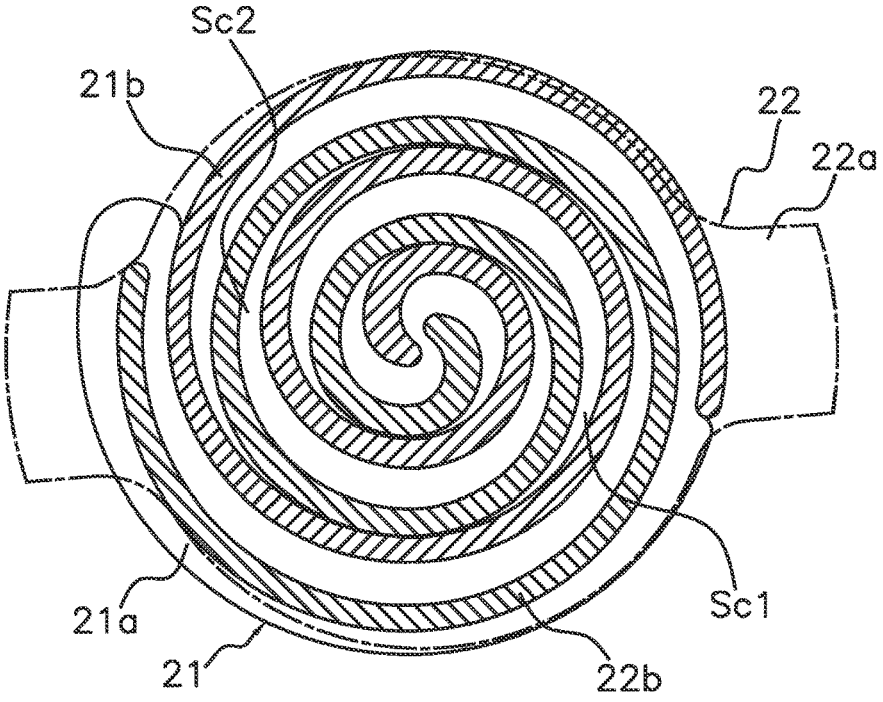
FIG. 5D is a diagram illustrating a state in which the phase is advanced by 90° from the state illustrated in FIG. 5C.

As illustrated in FIGS. 5A to 5D, the fixed scroll 21 and the movable scroll 22 form the first compression chamber Sc1 and the second compression chamber Sc2 while the movable scroll 22 is revolving. FIG. 5A illustrates a state in which the outer peripheries of the fixed-side wrap 21*b* and the movable-side wrap 22*b* are closed and a process of sucking the refrigerant is completed. In other words, FIG. 5A illustrates a first time point when the first compression chamber Sc1 and the second compression chamber Sc2 are formed.

As illustrated in FIG. 3, the fixed-side wrap 21*b* has a fixed-side reference point 21*f* located at an outermost periphery in plan view. As illustrated in FIG. 5A, the fixed-side reference point 21*f* is at a position in contact with a side surface of the movable-side wrap 22*b* at the first time point.

As illustrated in FIG. 4, the movable-side wrap 22*b* has a movable-side reference point 22*f* located at an outermost periphery in plan view. As illustrated in FIG. 5A, the movable-side reference point 22*f* is at a position in contact with a side surface of the fixed-side wrap 21*b* at the first time point.

During operation of the scroll compressor 100 in the normal state, the movable-side end plate 22*a* may be inclined with respect to a horizontal plane due to the force of the floating member 30 pressing the movable scroll 22 against the fixed scroll 21 and the pressure in the first compression chamber Sc1 and the second compression chamber Sc2. In other words, during the operation of the scroll compressor 100, the movable scroll 22 may be inclined with respect to the fixed scroll 21. Hereinafter, the force by which the floating member 30 presses the movable scroll 22 against the fixed scroll 21 during the operation of the scroll compressor 100 is referred to as a "pressing force".

The fixed-side dimension (the dimension of the fixed-side wrap 21*b* in the vertical direction) and the movable-side dimension (the dimension of the movable-side wrap 22*b* in the vertical direction) are set to satisfy the following first and second conditions when the movable scroll 22 is inclined with respect to the fixed scroll 21.

First condition: A fixed-side first region 21*j* included in the distal end surface of the fixed-side wrap 21*b* receives the pressing force.

Second condition: A movable-side first region 22*j* included in the distal end surface of the movable-side wrap 22*b* receives the pressing force.

The fixed-side first region 21*j* is a distal end surface of a part between 0.0 turns and 0.5 turns and a distal end surface of a part between 1.0 turns and 1.5 turns from the fixed-side reference point 21*f* toward the winding start 21*s* of the fixed-side wrap 21*b*.

The movable-side first region 22*j* is a distal end surface of a part between 0.0 turns and 0.5 turns and a distal end surface of a part between 1.0 turns and 1.5 turns from the movable-side reference point 22*f* toward the winding start 22*s* of the movable-side wrap 22*b*.

Here, a point one turn from a predetermined point is a point advanced by one turn (360°) along a direction in which the spiral of the wrap extends from the predetermined point in a plan view of the fixed-side wrap 21*b* and the movable-side wrap 22*b*.

In FIG. 3, the fixed-side first region 21*j* is indicated by a hatched region. In FIG. 4, the movable-side first region 22*j* is indicated by a hatched region.

The fixed-side dimension and the movable-side dimension are set, for example, by changing height positions of the distal end surfaces of the fixed-side wrap 21*b* and the movable-side wrap 22*b* or by changing height positions of the main surface 21*p* (lower surface) of the fixed-side end plate 21*a* and the main surface 22*p* (upper surface) of the movable-side end plate 22*a*.

Appropriate values of the fixed-side dimension and the movable-side dimension are determined in consideration of various factors such as a type of the scroll compressor 100, dimensions of the fixed scroll 21 and the movable scroll 22, a temperature of the refrigerant, and a pressure of the refrigerant. Therefore, the fixed-side dimension and the movable-side dimension are not uniquely determined.

Figure 6:
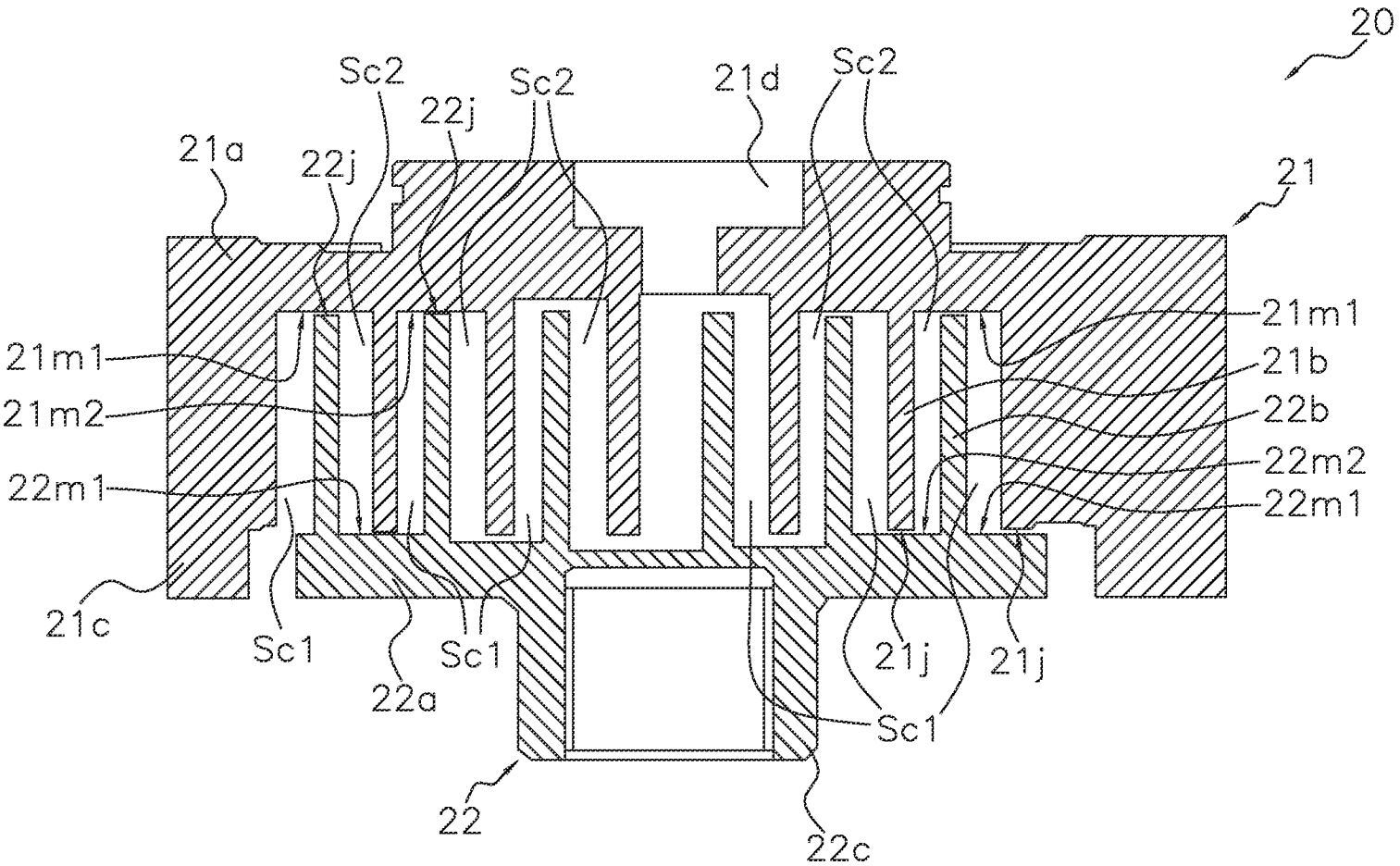
FIG. 6 is a longitudinal sectional view of the fixed scroll 21 and the movable scroll 22 according to the embodiment.
Figure 7:
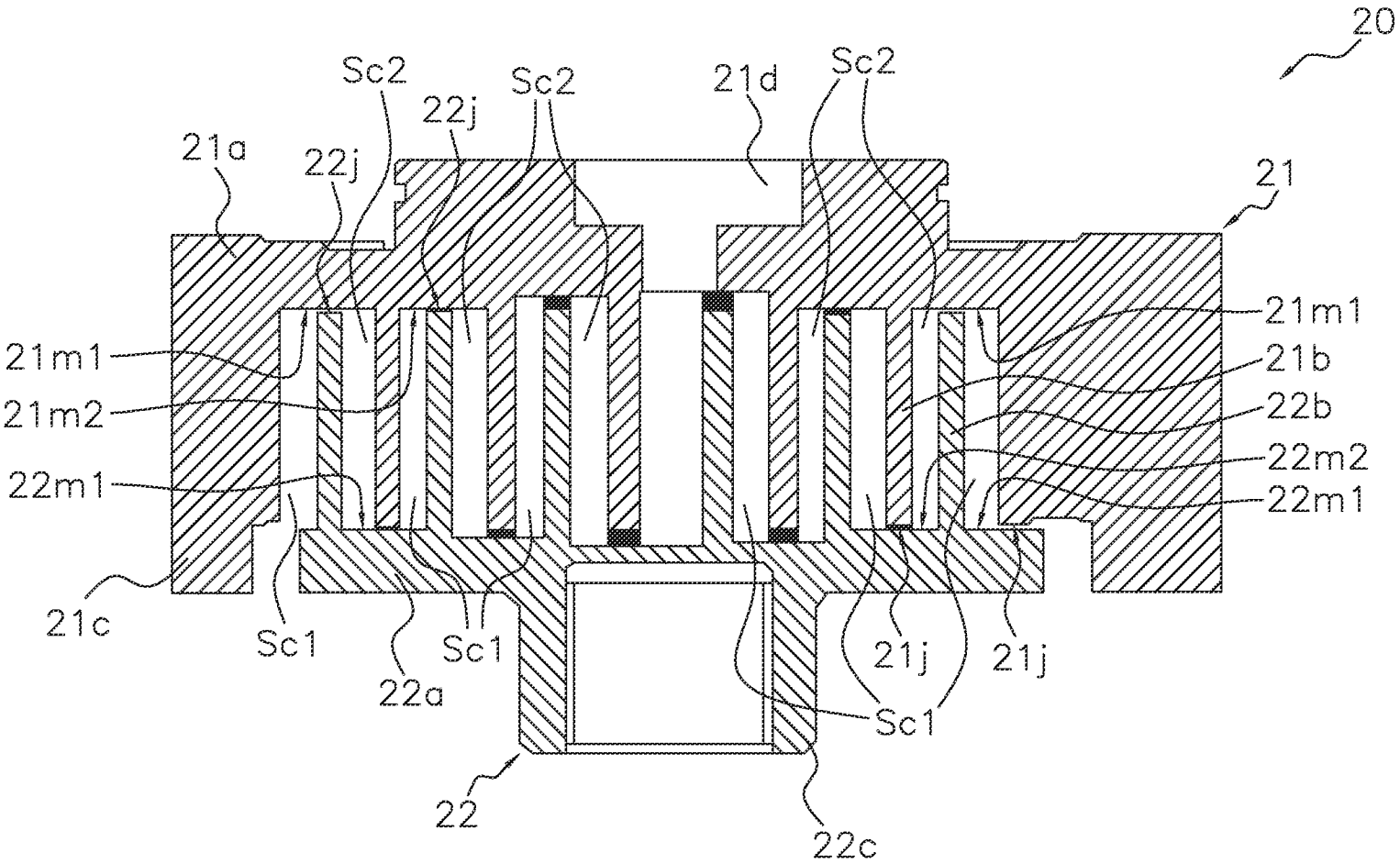
FIG. 7 is a longitudinal sectional view of the fixed scroll 21 and the movable scroll 22 according to the embodiment.
Figure 8:
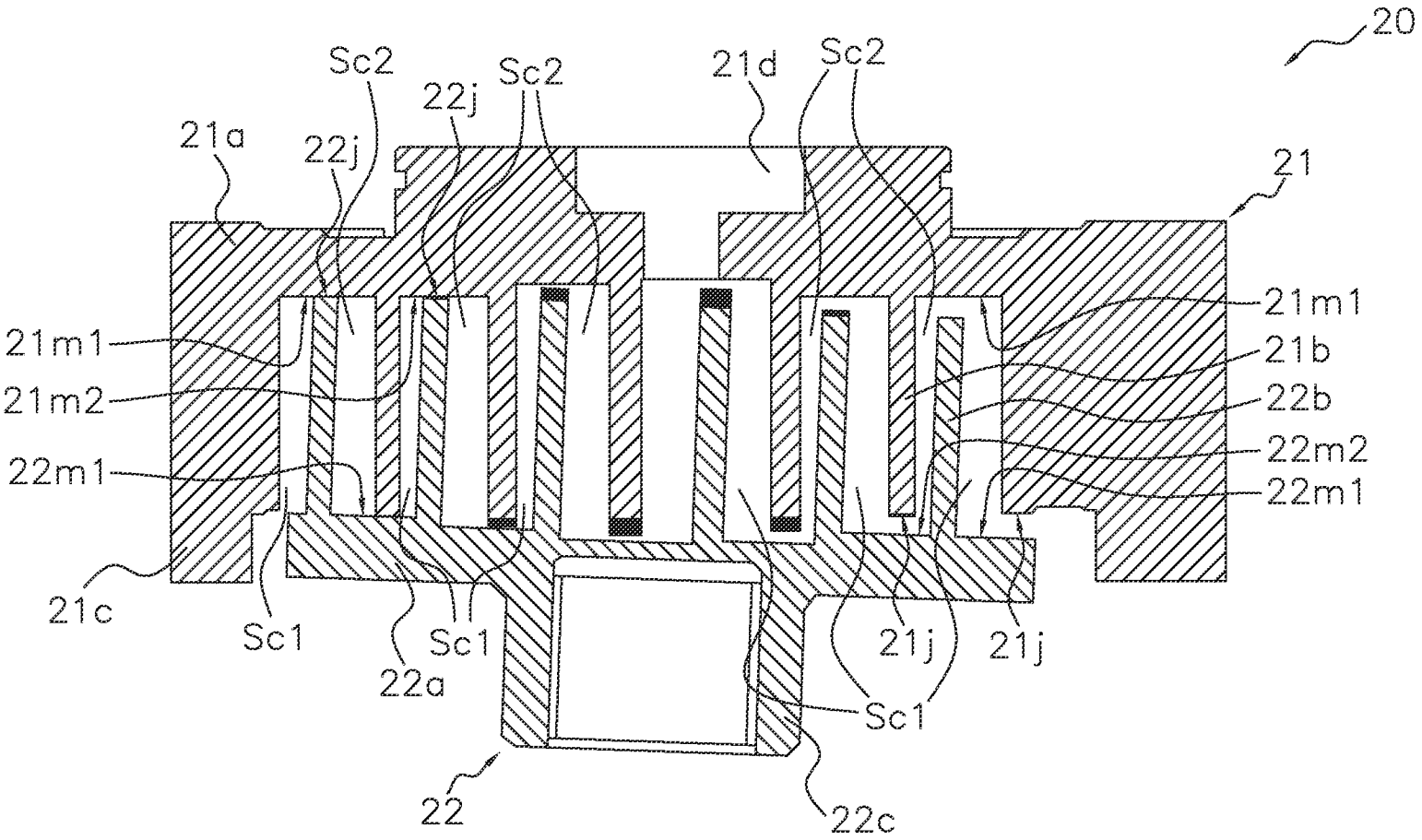
FIG. 8 is a longitudinal sectional view of the fixed scroll 21 and the movable scroll 22 according to the embodiment.
Figure 9:
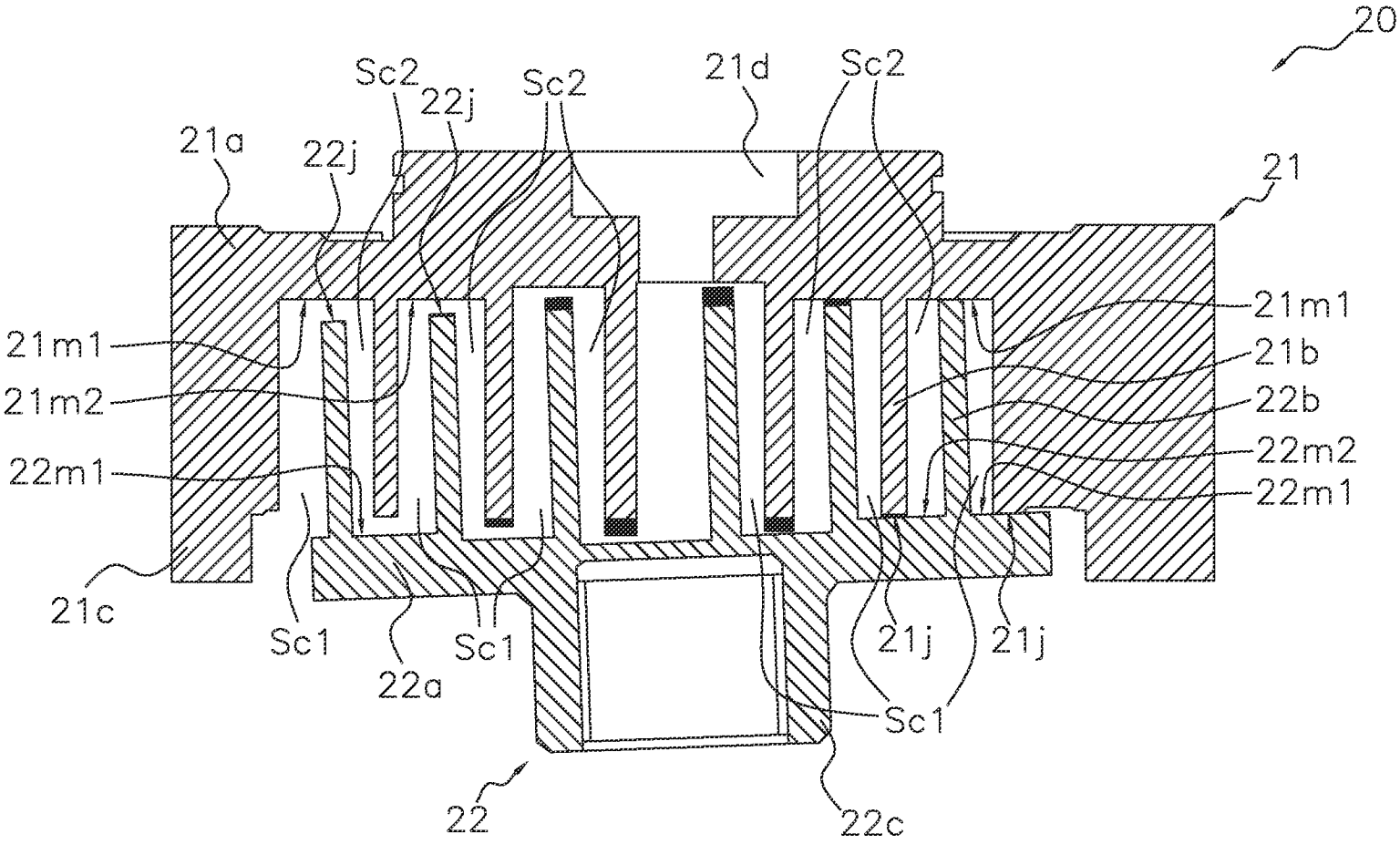
FIG. 9 is a longitudinal sectional view of the fixed scroll 21 and the movable scroll 22 according to the embodiment.

Next, a state when the movable scroll 22 is inclined with respect to the fixed scroll 21 will be described with reference to FIGS. 6 to 9. The fixed scroll 21 and the movable scroll 22 illustrated in FIGS. 6 to 9 are sectional views taken along line A-A in FIG. 3 and line B-B in FIG. 4. FIGS. 6 and 7 illustrate a state in which the movable scroll 22 is not inclined. FIGS. 8 and 9 illustrate a state in which the movable scroll 22 is inclined. FIG. 9 illustrates a state in which the movable scroll 22 has revolved by 180° from the state illustrated in FIG. 8. FIG. 6 illustrates a state in which deformation of the fixed scroll 21 and the movable scroll 22 does not occur. FIGS. 7 to 9 illustrate a state in which deformation of the fixed scroll 21 and the movable scroll 22 occurs. The deformation of the fixed scroll 21 and the movable scroll 22 is due to at least one of pressure or heat of the first compression chamber Sc1 or the second compression chamber Sc2. The inclination of the movable scroll 22 illustrated in FIGS. 8 to 9 and the deformation illustrated in FIGS. 7 to 9 are exaggerated from an actual state.

In the embodiment, the height positions of the main surfaces 21*p* and 22*p* of the fixed-side end plate 21*a* and the movable-side end plate 22*a* are adjusted such that the fixed-side first region 21*j* and the movable-side first region 22*j* receive the pressing force.

Specifically, as illustrated in FIG. 3, in the main surface 21*p* of the fixed-side end plate 21*a*, a height position of a fixed-side first range 21*m*1 between 0.0 turns and 1.0 turns from a first range reference position 21*q* is the same as a height position of a fixed-side second range 21*m*2 between 1.0 turns and 1.5 turns from the first range reference position 21*q*. The first range reference position 21*q* is the same position as the movable-side reference point 22*f* at the first time point when the fixed-side end plate 21*a* is viewed along the vertical direction. The distal end surface of the movable-side wrap 22*b* is in contact with the fixed-side first range 21*m*1 in a part between 0.0 turns and 1.0 turns and is in contact with the fixed-side second range 21*m*2 in a part between 1.0 turns and 1.5 turns from the movable-side reference point 22*f* toward the winding start 22*s* of the movable-side wrap 22*b*.

Similarly, as illustrated in FIG. 4, in the main surface 22*p* of the movable-side end plate 22*a*, a height position of a movable-side first range 22*m*1 between 0.0 turns and 1.0 turns from a second range reference position 22*q* is the same as a height position of a movable-side second range 22*m*2 between 1.0 turns and 1.5 turns from the second range reference position 22*q*. The second range reference position 22*q* is the same position as the fixed-side reference point 21*f* at the first time point when the movable-side end plate 22*a* is viewed along the vertical direction. The distal end surface of the fixed-side wrap 21*b* is in contact with the movable-side first range 22*m*1 in a part between 0.0 turns and 1.0 turns and is in contact with the movable-side second range 22*m*2 in a part between 1.0 turns and 1.5 turns from the fixed-side reference point 21*f* toward the winding start 21*s* of the fixed-side wrap 21*b*.

As a result, the fixed-side second range 21*m*2 and the movable-side second range 22*m*2 are shallower than a conventional configuration by the inclination of the movable scroll 22. The height positions of the fixed-side second range 21*m*2 and the movable-side second range 22*m*2 need not be the same as the height positions of the fixed-side first range 21*m*1 and the movable-side first range 22*m*1, respectively.

Description will be made of a setting of the fixed-side dimension and the movable-side dimension to satisfy the first condition and the second condition. In FIGS. 7 to 9, an increase in the fixed-side dimension and the movable-side dimension due to the deformation of the fixed scroll 21 and the movable scroll 22 is indicated by a filled region. In FIG. 8, the movable-side first region 22*j* of the movable-side wrap 22*b* is in contact with the fixed-side first range 21*m*1 and the fixed-side second range 21*m*2 of the fixed-side end plate 21*a*. At this time, since the movable-side first region 22*j* receives the pressing force, the movable-side wrap 22*b* receives a thrust load in the movable-side first region 22*j*. In FIG. 9, the fixed-side first region 21*j* of the fixed-side wrap 21*b* is in contact with the movable-side first range 22*m*1 and the movable-side second range 22*m*2 of the movable-side end plate 22*a*. At this time, since the fixed-side first region 21*j* receives the pressing force, the fixed-side wrap 21*b* receives a thrust load in the fixed-side first region 21*j*.

(5) Characteristics

In the scroll compressor 100, as illustrated in FIGS. 8 and 9, when the movable scroll 22 is inclined with respect to the fixed scroll 21, the movable-side first region 22*j* of the movable-side wrap 22*b* or the fixed-side first region 21*j* of the fixed-side wrap 21*b* receives a thrust load.

In a conventional scroll compressor, the fixed-side dimension and the movable-side dimension do not satisfy the first condition and the second condition. Therefore, in the conventional scroll compressor, the regions of the distal end surfaces of the fixed-side wrap 21*b* and the movable-side wrap 22*b* receiving the thrust load when the movable scroll 22 is inclined is smaller than the fixed-side first region 21*j* and the movable-side first region 22*j*. For example, in the conventional scroll compressor, only the distal end surface of the part between 0.0 turns and 0.5 turns from the fixed-side reference point 21*f* toward the winding start 21*s* of the fixed-side wrap 21*b* and the distal end surface of the part between 0.0 turns and 0.5 turns from the movable-side reference point 22*f* toward the winding start 22*s* of the movable-side wrap 22*b* receive the thrust load. Therefore, in the conventional scroll compressor, a pressure of the thrust load received by the wrap distal end surface that receives the thrust load is higher than a pressure of the thrust load received by the fixed-side first region 21*j* and the movable-side first region 22*j* in the embodiment. When the pressure applied to the distal end surfaces of the fixed-side wrap 21*b* and the movable-side wrap 22*b* is high while the movable scroll 22 is revolving, an excessive surface pressure is generated on the bottom surfaces (main surfaces 21*p* and 22*p*) of the fixed-side end plate 21*a* and the movable-side end plate 22*a*. As a result, the bottom surfaces of the fixed-side end plate 21*a* and the movable-side end plate 22*a* wear, the inclination of the movable scroll 22 increases, and an amount of leakage of the refrigerant from the first compression chamber Sc1 and the second compression chamber Sc2 increases.

Thus, in the embodiment, by sufficiently securing the regions (the fixed-side first region 21*j* and the movable-side first region 22*j*) of the distal end surfaces of the fixed-side wrap 21*b* and the movable-side wrap 22*b* on which the pressure due to the thrust load acts, wear of the fixed scroll 21 and the movable scroll 22 is suppressed, and a decrease in efficiency of the scroll compressor 100 is suppressed.

In the scroll compressor 100, the fixed-side first region 21*j* and the movable-side first region 22*j* are formed near the outermost peripheries of the fixed-side wrap 21*b* and the movable-side wrap 22*b*, respectively. Therefore, the amount of the refrigerant leaking from the compression chamber Sc on the peripheral edge (outer side) into the first space S1 is reduced and, thus, a decrease in efficiency of the scroll compressor 100 is suppressed.

(6) Modifications (6-1) Modification A

In the scroll compressor 100 according to the embodiment, the fixed-side dimension and the movable-side dimension may also be set to satisfy the following third and fourth conditions when deformation the fixed scroll 21 and the movable scroll 22 occurs.

Third condition: A fixed-side second region 21*k* included in the distal end surface of the fixed-side wrap 21*b* does not receive the pressing force.

Fourth condition: A movable-side second region 22*k* included in the distal end surface of the movable-side wrap 22*b* does not receive the pressing force.

Figure 10:
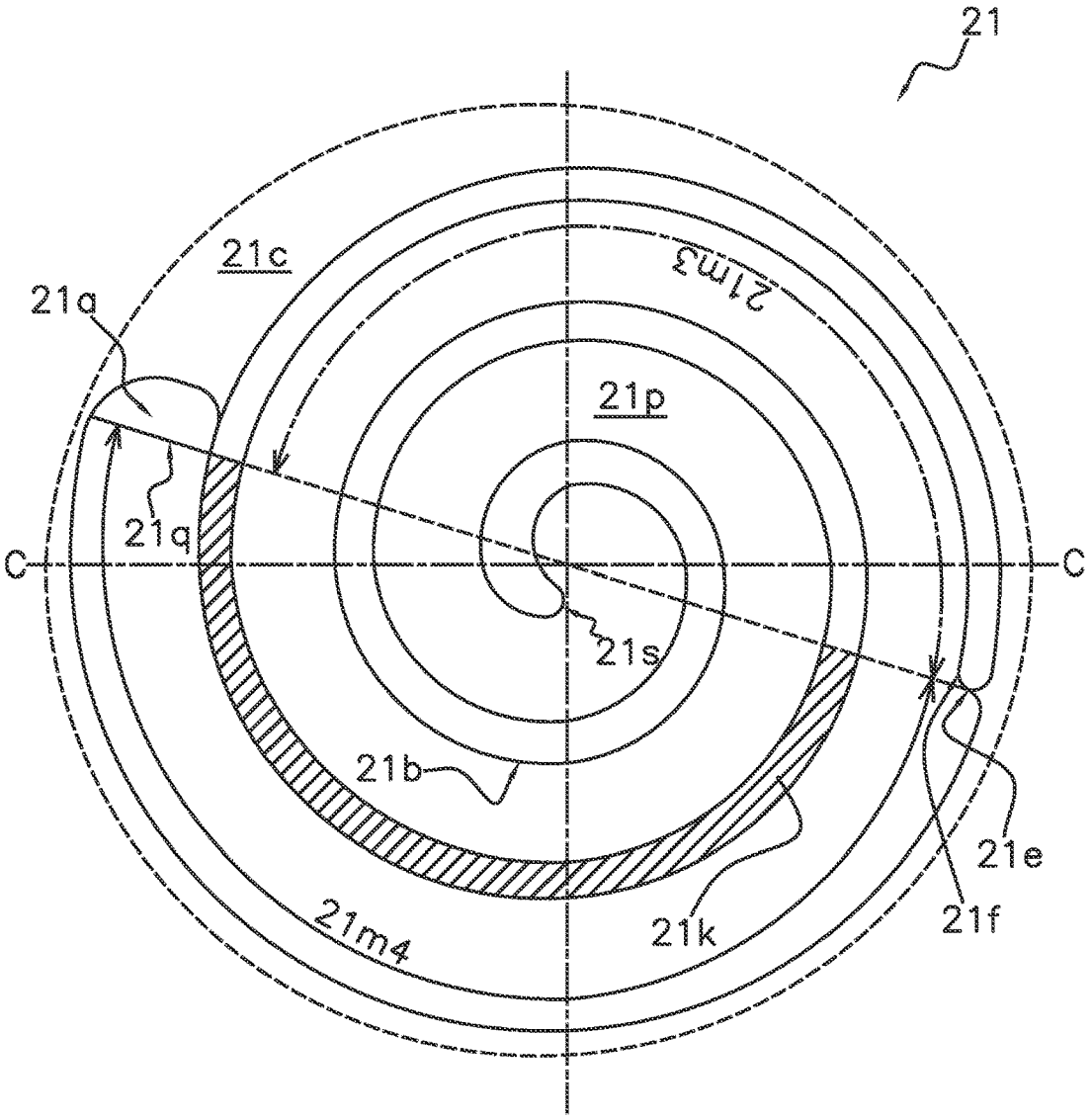
FIG. 10 is a plan view of the fixed scroll 21 according to Modification A.

As illustrated in FIG. 10, the fixed-side second region 21*k* is a distal end surface of a part between 0.5 turns and 1.0 turns from the fixed-side reference point 21*f*.

Figure 11:
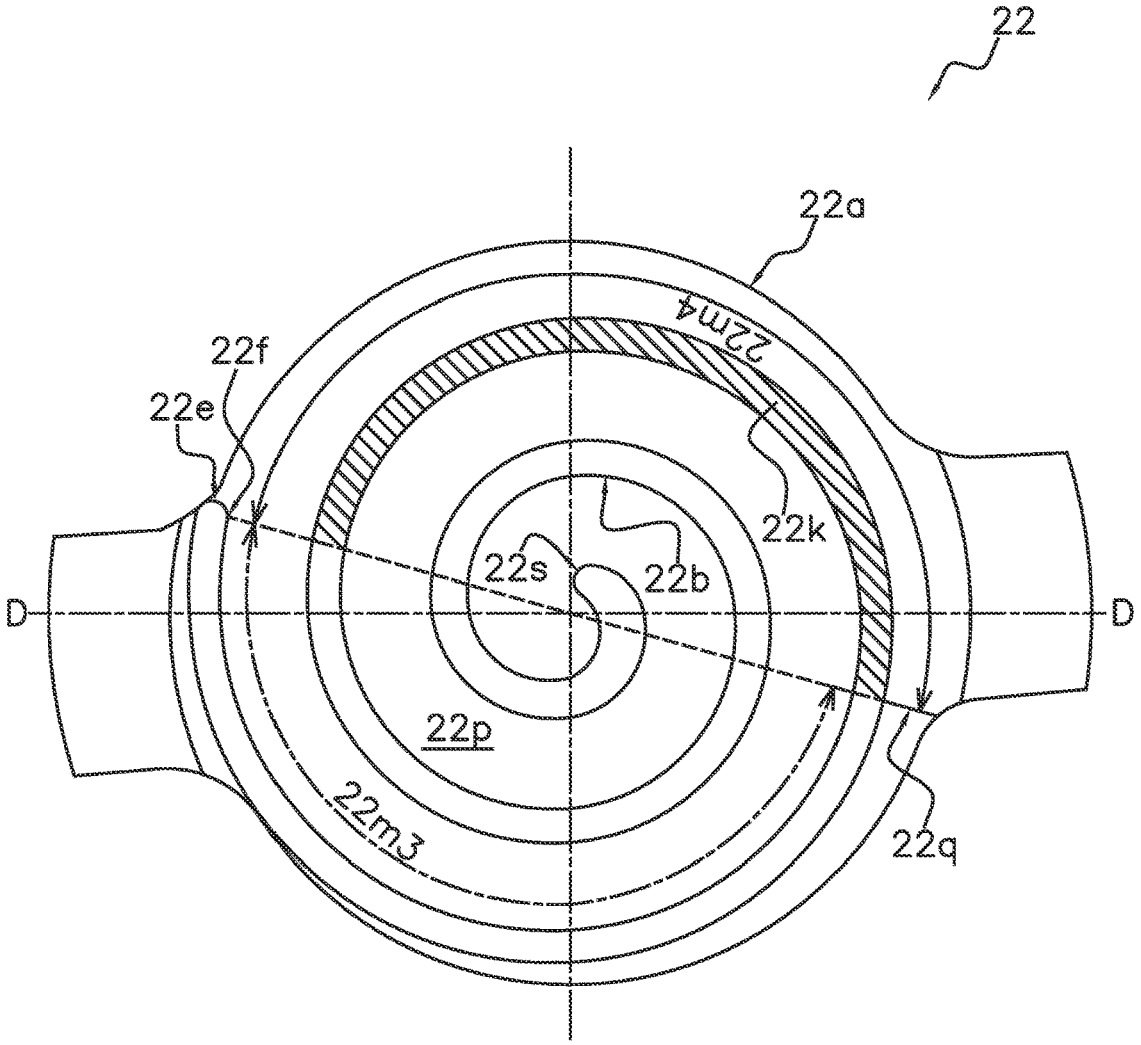
FIG. 11 is a plan view of the movable scroll 22 according to Modification A.

As illustrated in FIG. 11, the movable-side second region 22*k* is a distal end surface of a part between 0.5 turns and 1.0 turns from the movable-side reference point 22*f*.

In FIG. 10, the fixed-side second region 21*k* is indicated by a hatched region. In FIG. 11, the movable-side second region 22*k* is indicated by a hatched region.

Figure 12:
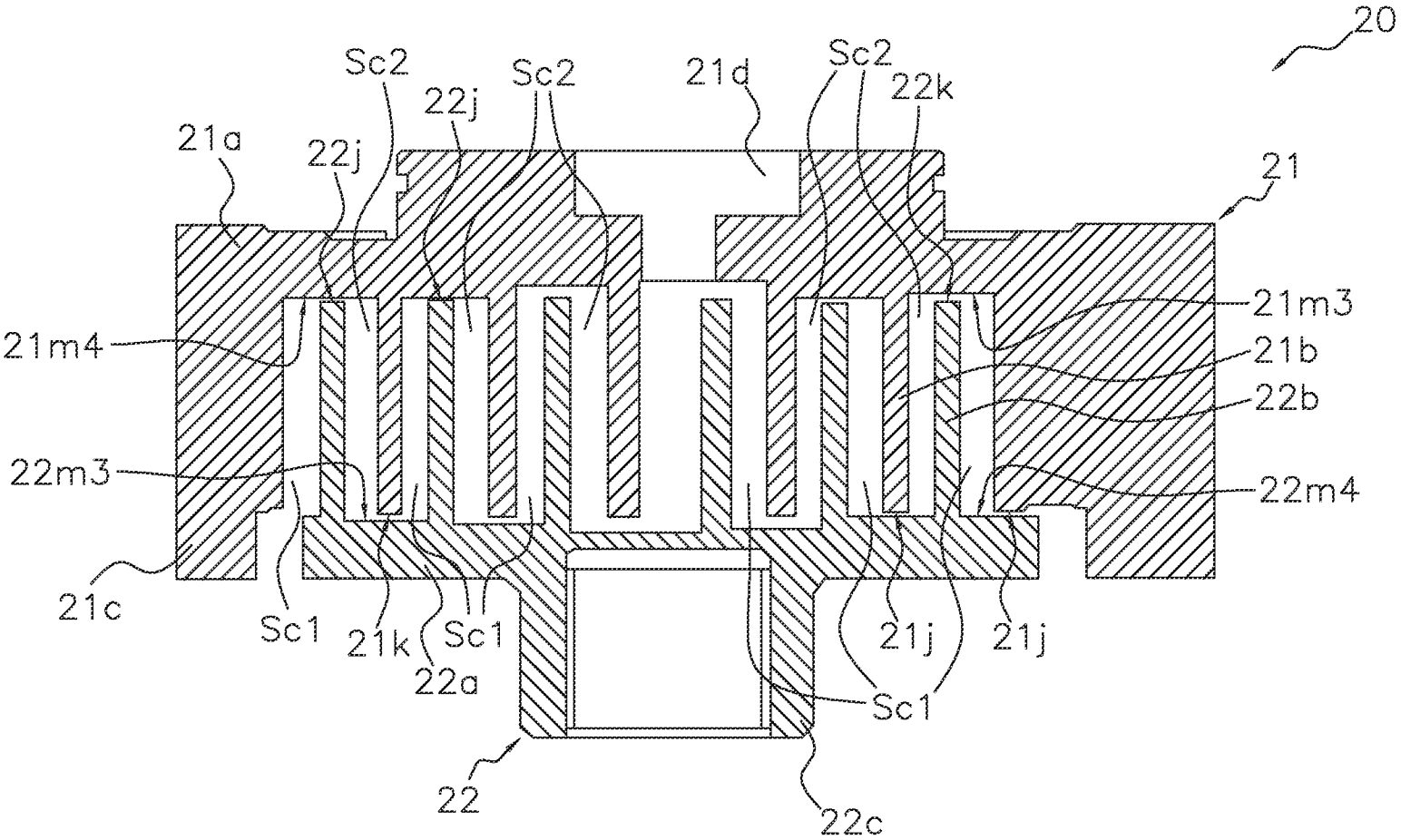
FIG. 12 is a longitudinal sectional view of the fixed scroll 21 and the movable scroll 22 according to Modification A.
Figure 13:
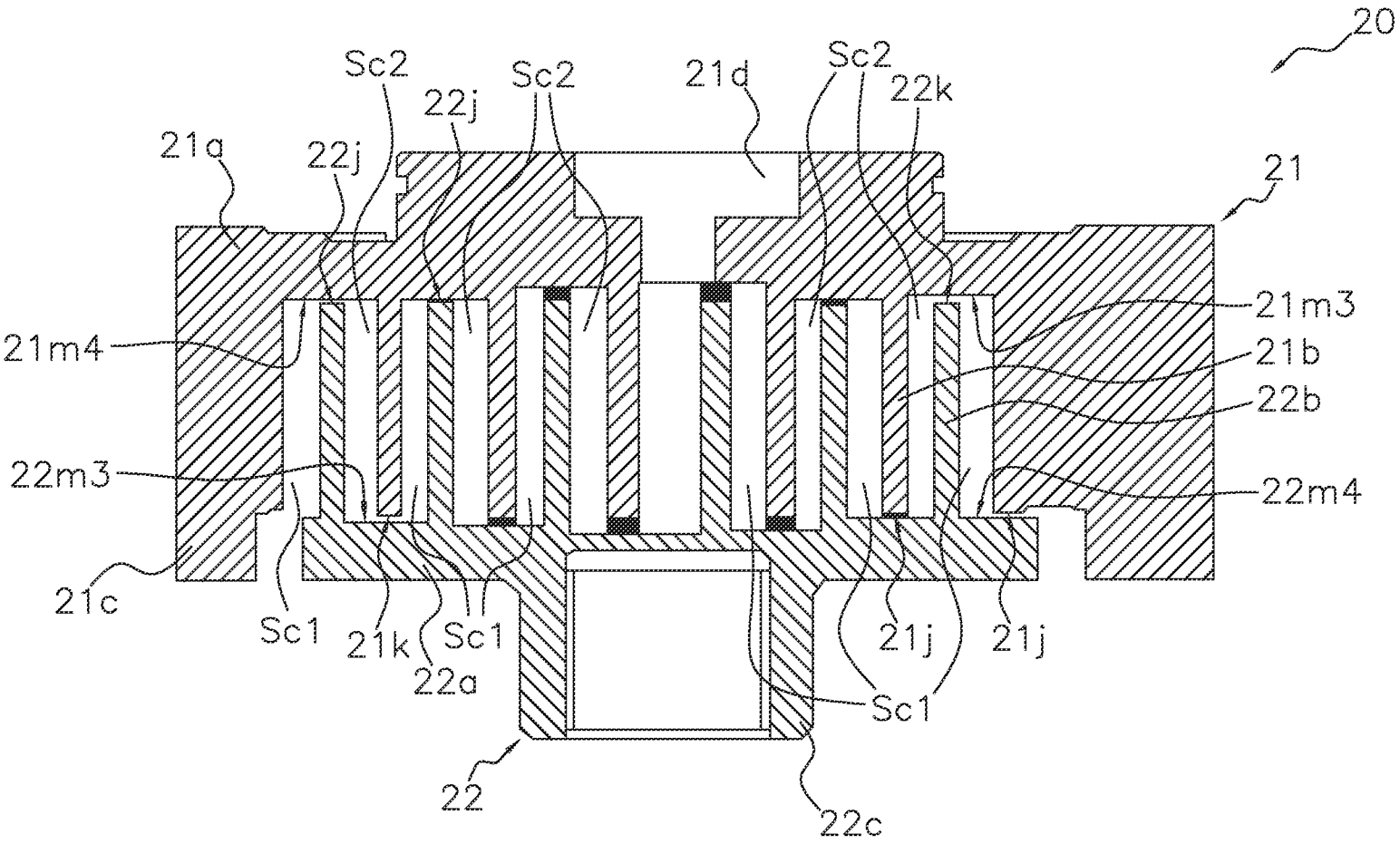
FIG. 13 is a longitudinal sectional view of the fixed scroll 21 and the movable scroll 22 according to Modification A.
Figure 14:
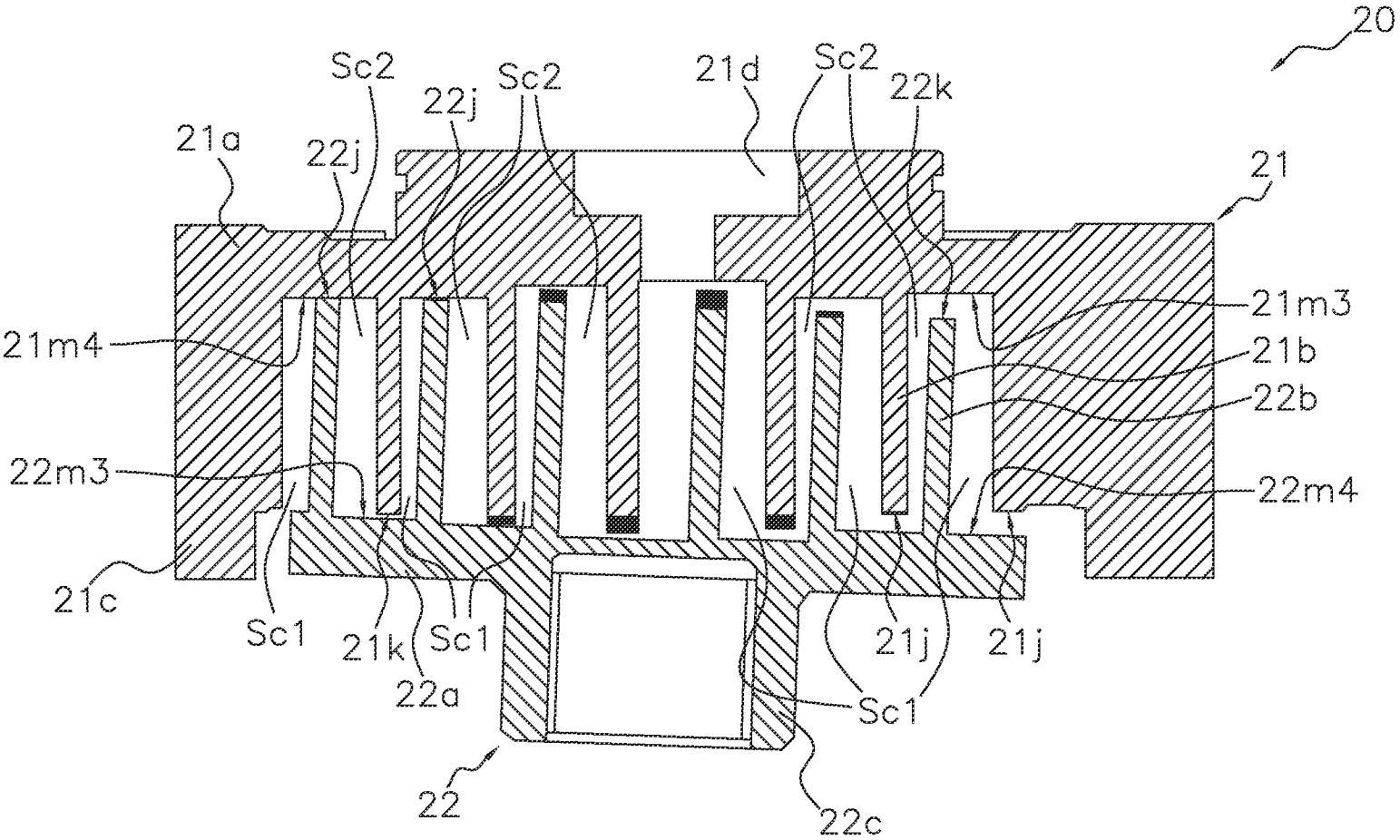
FIG. 14 is a longitudinal sectional view of the fixed scroll 21 and the movable scroll 22 according to Modification A.
Figure 15:
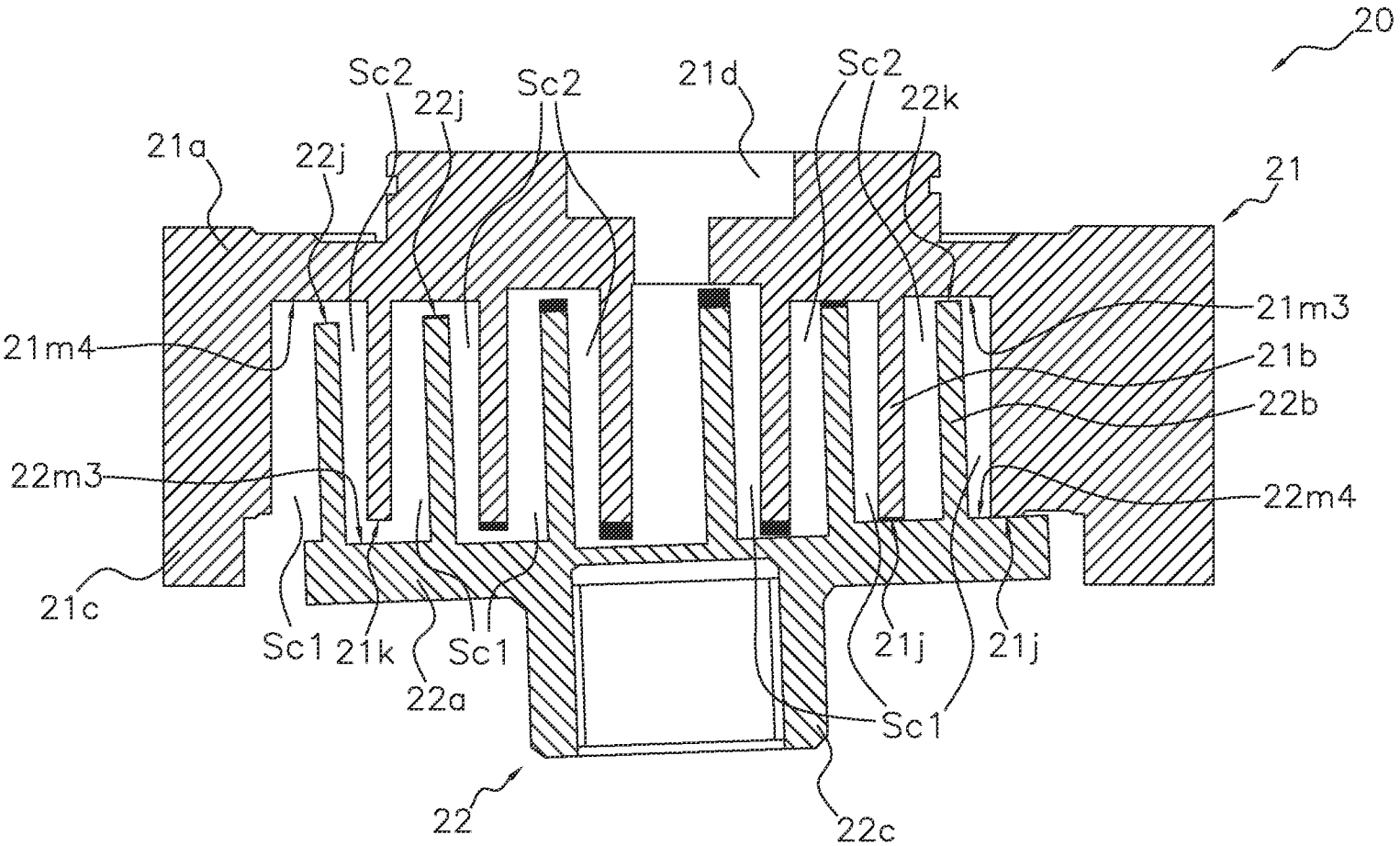
FIG. 15 is a longitudinal sectional view of the fixed scroll 21 and the movable scroll 22 according to Modification A.

Next, a state when the movable scroll 22 is inclined with respect to the fixed scroll 21 will be described with reference to FIGS. 12 to 15. The fixed scroll 21 and the movable scroll 22 illustrated in FIGS. 12 to 15 are sectional views taken along line C-C in FIG. 10 and line D-D in FIG. 11. FIGS. 12 and 13 illustrate a state in which the movable scroll 22 is not inclined. FIGS. 14 and 15 illustrate a state in which the movable scroll 22 is inclined. FIG. illustrates a state in which the movable scroll 22 has revolved by 180° from the state illustrated in FIG. 14. FIG. 12 illustrates a state in which deformation of the fixed scroll 21 and the movable scroll 22 does not occur. FIGS. 13 to 15 illustrate a state in which deformation of the fixed scroll 21 and the movable scroll 22 occurs. The deformation of the fixed scroll 21 and the movable scroll 22 is due to at least one of pressure or heat of the first compression chamber Sc1 or the second compression chamber Sc2.

In the present modification, the height positions of the main surfaces 21*p* and 22*p* of the fixed-side end plate 21*a* and the movable-side end plate 22*a* arm adjusted such that the fixed-side second region 21*k* and the movable-side second region 22*k* do not receive the pressing force.

Specifically, as illustrated in FIG. 10, in the main surface 21*p* of the fixed-side end plate 21*a*, a height position of a fixed-side third range 21*m*3 between 0.5 turns and 1.0 turns from the first range reference position 21*q* is higher than a height position of a fixed-side fourth range 21*m*4 between 0.0 turns and 0.5 turns from the first range reference position 21*q*.

Similarly, as illustrated in FIG. 11, in the main surface 22*p* of the movable-side end plate 22*a*, a height position of a movable-side third range 22*m*3 between 0.5 turns and 1.0 turns from the second range reference position 22*q* is lower than a height position of a movable-side fourth range 22*m*4 between 0.0 turns and 0.5 turns from the second range reference position 22*q*.

As a result, the fixed-side third range 21*m*3 and the movable-side third range 22*m*3 are deeper than the conventional configuration in consideration of the deformation of the fixed scroll 21 and the movable scroll 22.

Description will be made of a setting of the fixed-side dimension and the movable-side dimension to satisfy the third condition and the fourth condition. In FIGS. 13 to 15, an increase in the fixed-side dimension and the movable-side dimension due to the deformation of the fixed scroll 21 and the movable scroll 22 is indicated by a filled region. In FIG. 14, the fixed-side second region 21*k* of the fixed-side wrap 21*b* is not in contact with the movable-side third range 22*m*3 of the movable-side end plate 22*a*. At this time, since the fixed-side second region 21*k* does not receive the pressing force, the fixed-side wrap 21*b* does not receive a thrust load in the fixed-side second region 21*k*. In FIG. 15, the movable-side second region 22*k* of the movable-side wrap 22*b* is not in contact with the fixed-side third range 21*m*3 of the fixed-side end plate 21*a*. At this time, since the movable-side second region 22*k* does not receive the pressing force, the movable-side wrap 22*b* does not receive a thrust load in the movable-side second region 22*k*.

Thus, in the present modification, in a state where the movable scroll 22 is inclined and the fixed scroll 21 and the movable scroll 22 are deformed, the fixed-side second region 21*k* and the movable-side second region 22*k* do not receive the thrust load. Therefore, the fixed-side first region 21*j* and the movable-side first region 22*j* can receive the thrust load effectively. Accordingly, wear of the fixed scroll 21 and the movable scroll 22 is suppressed, and a decrease in efficiency of the scroll compressor 100 is suppressed.

(6-2) Modification B

In the scroll compressor 100 according to the embodiment, the fixed-side reference point 21*f* and the movable-side reference point 22*f* are positions (closing positions) in contact with the side surfaces of the movable-side wrap 22*b* and the fixed-side wrap 21*b*, respectively, at the first time point. However, the fixed-side reference point 21*f* and the movable-side reference point 22*f* need not be the closing positions. Next, the fixed-side reference point 21*f* and the movable-side reference point 22*f* in the present modification will be described.

Figure 16:
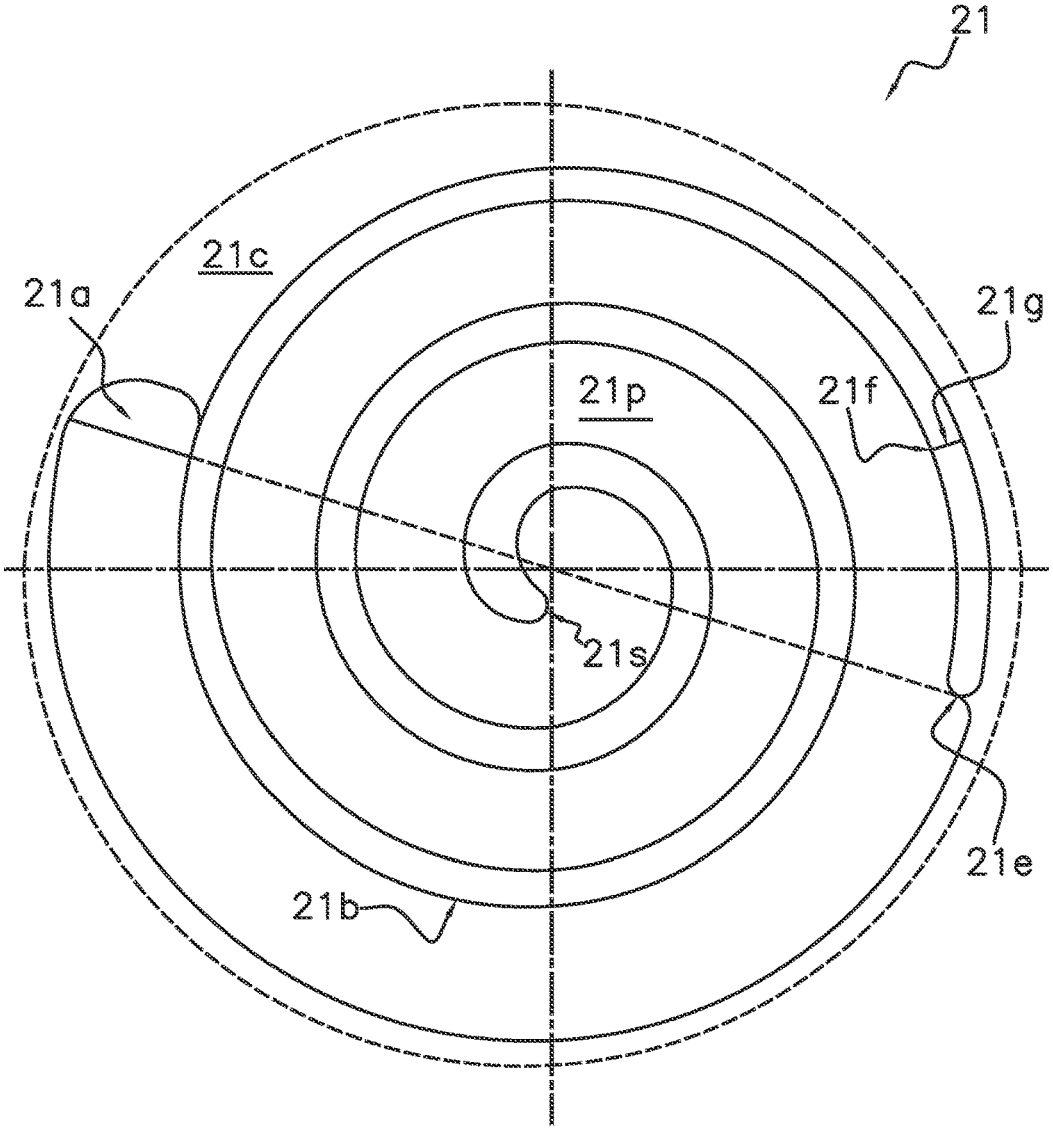
FIG. 16 is a plan view of the fixed scroll 21 according to Modification B.

As shown in FIG. 16, the fixed-side wrap 21*b* has a fixed-side step 21*g* formed on the distal end surface of the fixed-side wrap 21*b* on the outermost periphery of the fixed-side wrap 21*b*. The fixed-side reference point 21*f* is located at a point where the fixed-side step 21*g* is located in a direction in which the distal end surface of the fixed-side wrap 21*b* extends. The height position of the distal end surface from the winding end 21*e* to the fixed-side step 21*g* is lower than the height position of the distal end surface from the fixed-side step 21*g* to the winding start 21*s*. A dimension of the fixed-side step 21*g* in the vertical direction is, for example, 50 μm. A position of the fixed-side step 21*g* in a peripheral direction of the fixed-side wrap 21*b* is, for example, in a range of 30° to 60° from the winding end 21*c*.

Figure 17:
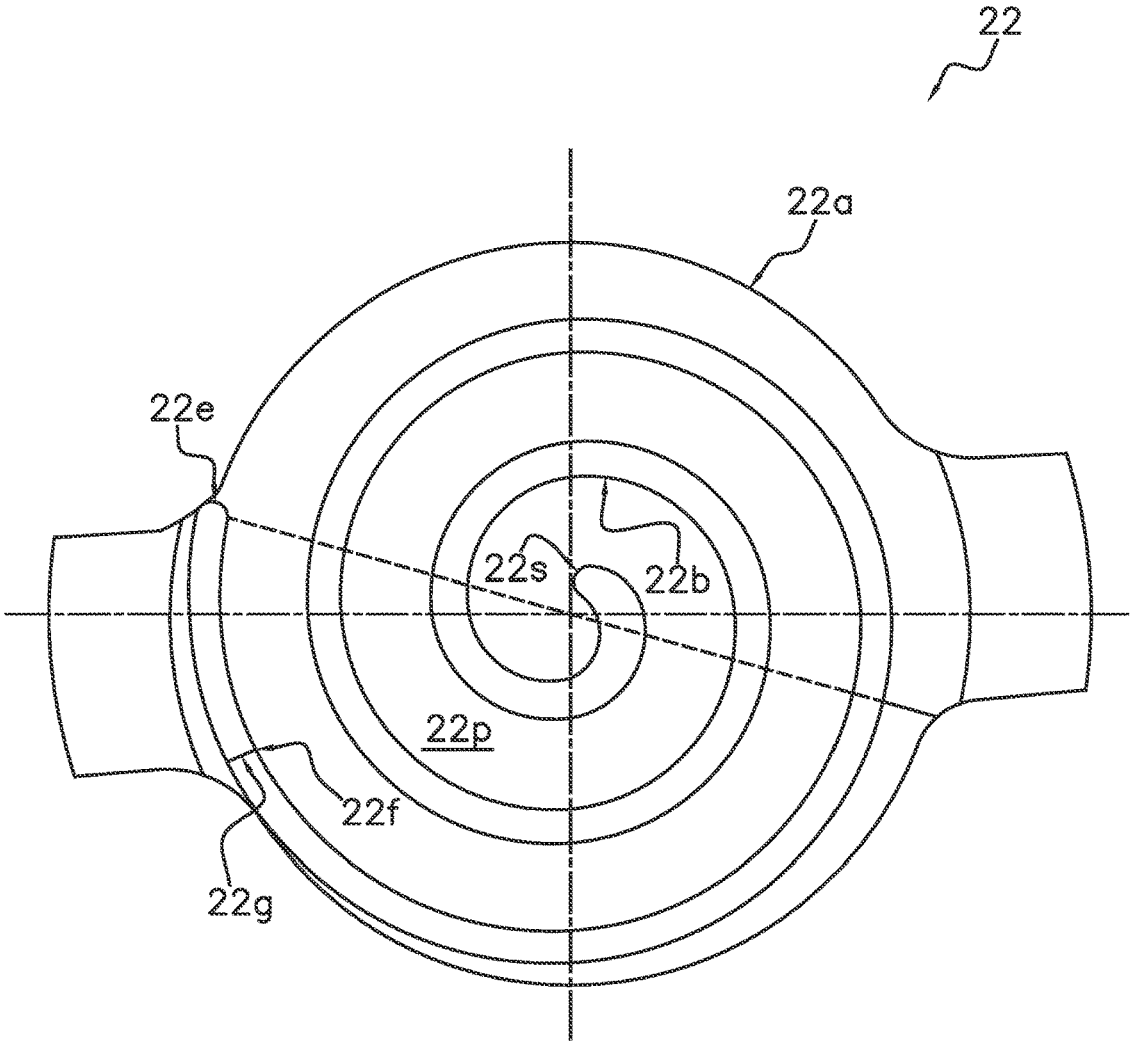
FIG. 17 is a plan view of the movable scroll 22 according to Modification B.

As shown in FIG. 17, the movable-side wrap 22*b* has a movable-side step 22*g* formed on the distal end surface of the movable-side wrap 22*b* on the outermost periphery of the movable-side wrap 22*b*. The movable-side reference point 22*f* is located at a point where the movable-side step 22*g* is located in a direction in which the distal end surface of the movable-side wrap 22*b* extends. The height position of the distal end surface from the winding end 22*e* to the movable-side step 22*g* is lower than the height position of the distal end surface from the movable-side step 22*g* to the winding start 22*s*. A dimension of the movable-side step 22*g* in the vertical direction is, for example, 50 μm. A position of the movable-side step 22*g* in a peripheral direction of the movable-side wrap 22*b* is, for example, in a range of 30° to 60° from the winding end 22*e*.

In the present modification, the fixed-side step 21*g* and the movable-side step 22*g* suppress concentration of a thrust load on the winding end 21*e* of the fixed-side wrap 21*b* and the winding end 22*e* of the movable-side wrap 22*b* when the wrap receiving the pressing force is switched between the fixed-side wrap 21*b* and the movable-side wrap 22*b*. Accordingly, a surface pressure applied to the fixed-side wrap 21*b* and the movable-side wrap 22*b* is reduced. Thus, wear of the fixed scroll 21 and the movable scroll 22 is suppressed, and a decrease in efficiency of the scroll compressor 100 is suppressed.

(6-3) Modification C

The scroll compressor 100 according to the embodiment includes the floating member 30 that presses the movable scroll 22 against the fixed scroll 21. Alternatively, the scroll compressor 100 may be a compressor not including the floating member 30.

(6-4) Modification D

Figure 19:
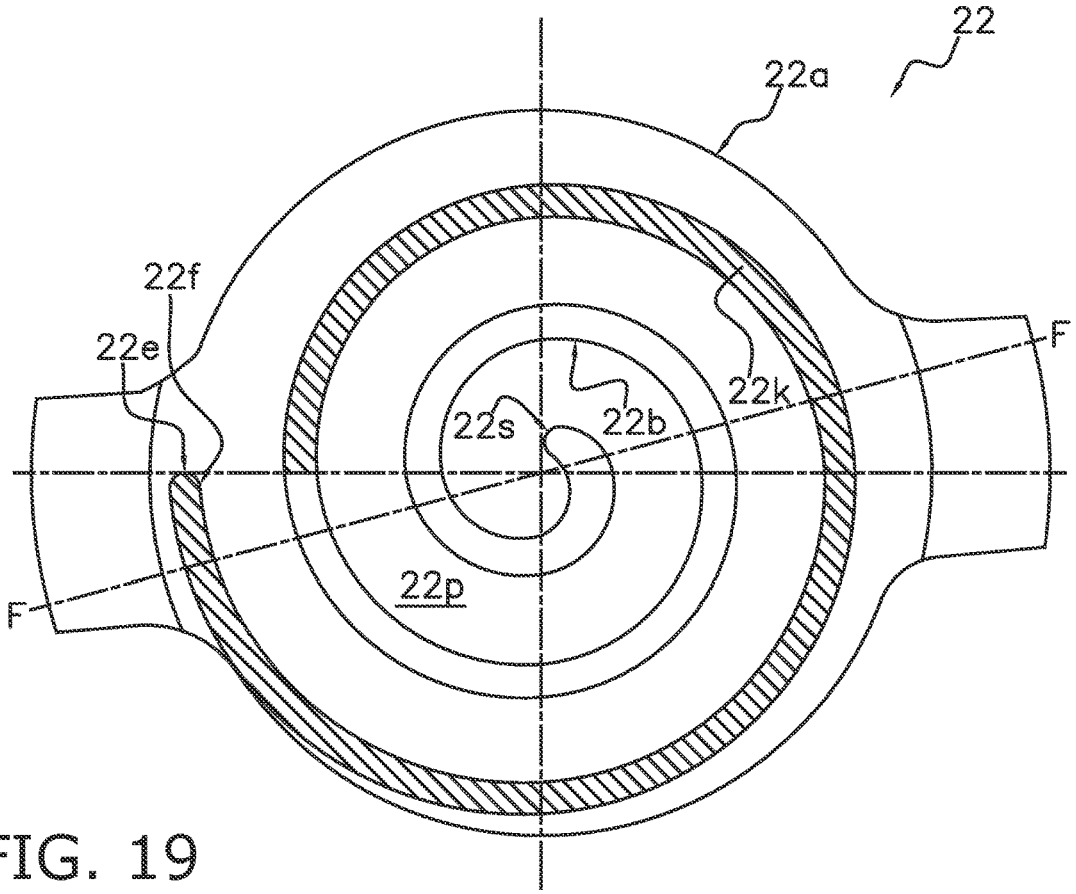
FIG. 19 is a plan view of the movable scroll 22 according to Modification D.
Figure 20:
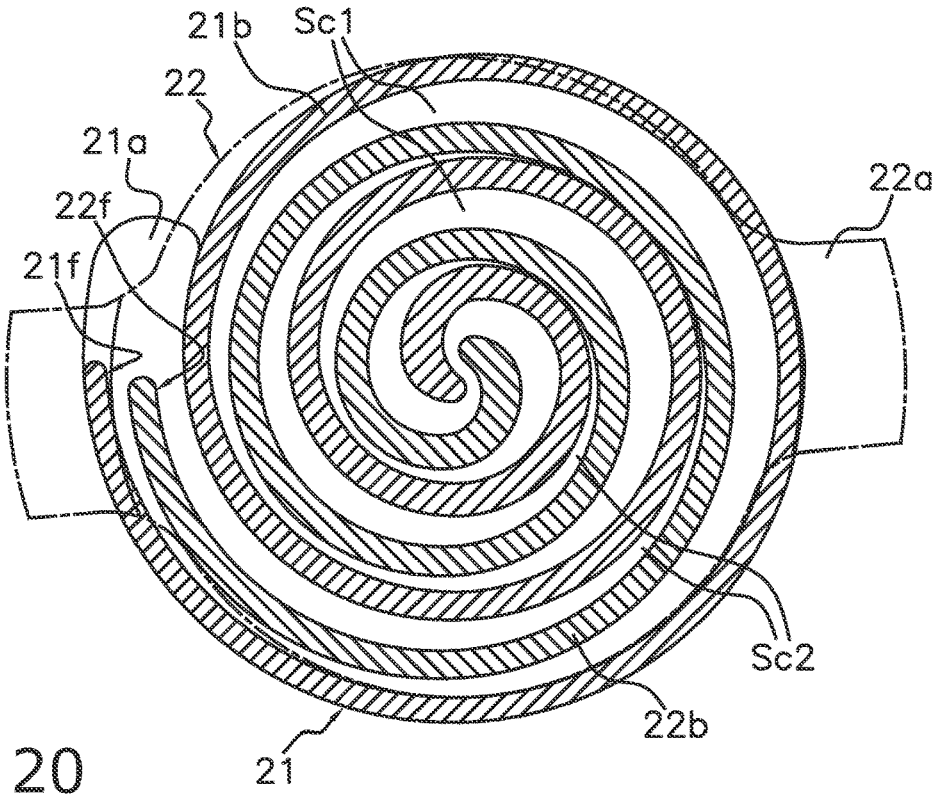
FIG. 20 is a diagram illustrating a state in which the fixed scroll 21 and the movable scroll 22 according to Modification D meshing with each other as viewed from above.

The compression mechanism 20 of the scroll compressor 100 according to the embodiment has a symmetric wrap structure. Alternatively, the compression mechanism 20 may have an asymmetric wrap structure. In the compression mechanism 20 having the asymmetric wrap structure illustrated in FIGS. 18 and 19, the number of turns of the fixed-side wrap 21*b* and the number of turns of the movable-side wrap 22*b* are different from each other. As illustrated in FIG. 20, in the compression mechanism 20 having an asymmetrical wrap structure, the compression chamber surrounded by the outer peripheral surface of the movable-side wrap 22*b* and the inner peripheral surface of the fixed-side wrap 21*b* (first compression chamber Sc1) and the compression chamber surrounded by the inner peripheral surface of the movable-side wrap 22*b* and the outer peripheral surface of the fixed-side wrap 21*b* (second compression chamber Sc2) are not in point-symmetry when viewed along the vertical direction (first direction). The winding end angle of the movable-side wrap 22*b* is different from the winding end angle of the fixed-side wrap 21*b*. In the compression mechanism 20 having an asymmetrical wrap structure, the refrigerant is compressed in the first compression chamber Sc1 and in the second compression chamber Sc2 at different timings.

Figure 18:
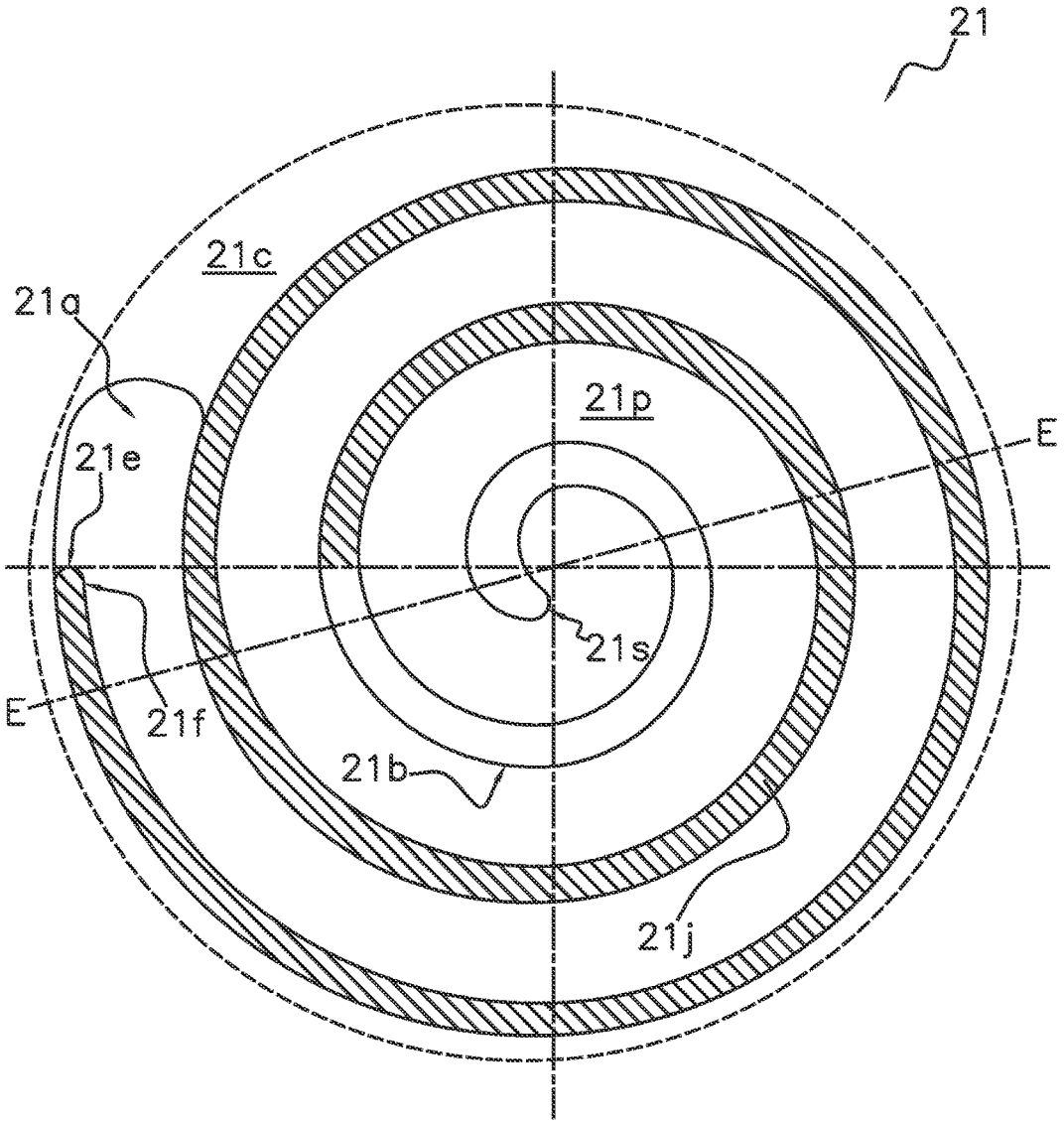
FIG. 18 is a plan view of the fixed scroll 21 according to Modification D.

In the present modification, the fixed-side first region 21*j* is a distal end surface of apart between 0.0 turns and 2.0 turns from the fixed-side reference point 21*f*. A definition of the fixed-side reference point 21*f* is the same as that of the embodiment or Modification B. In FIG. 18, the fixed-side first region 21*j* is indicated by a hatched region.

Figure 21:
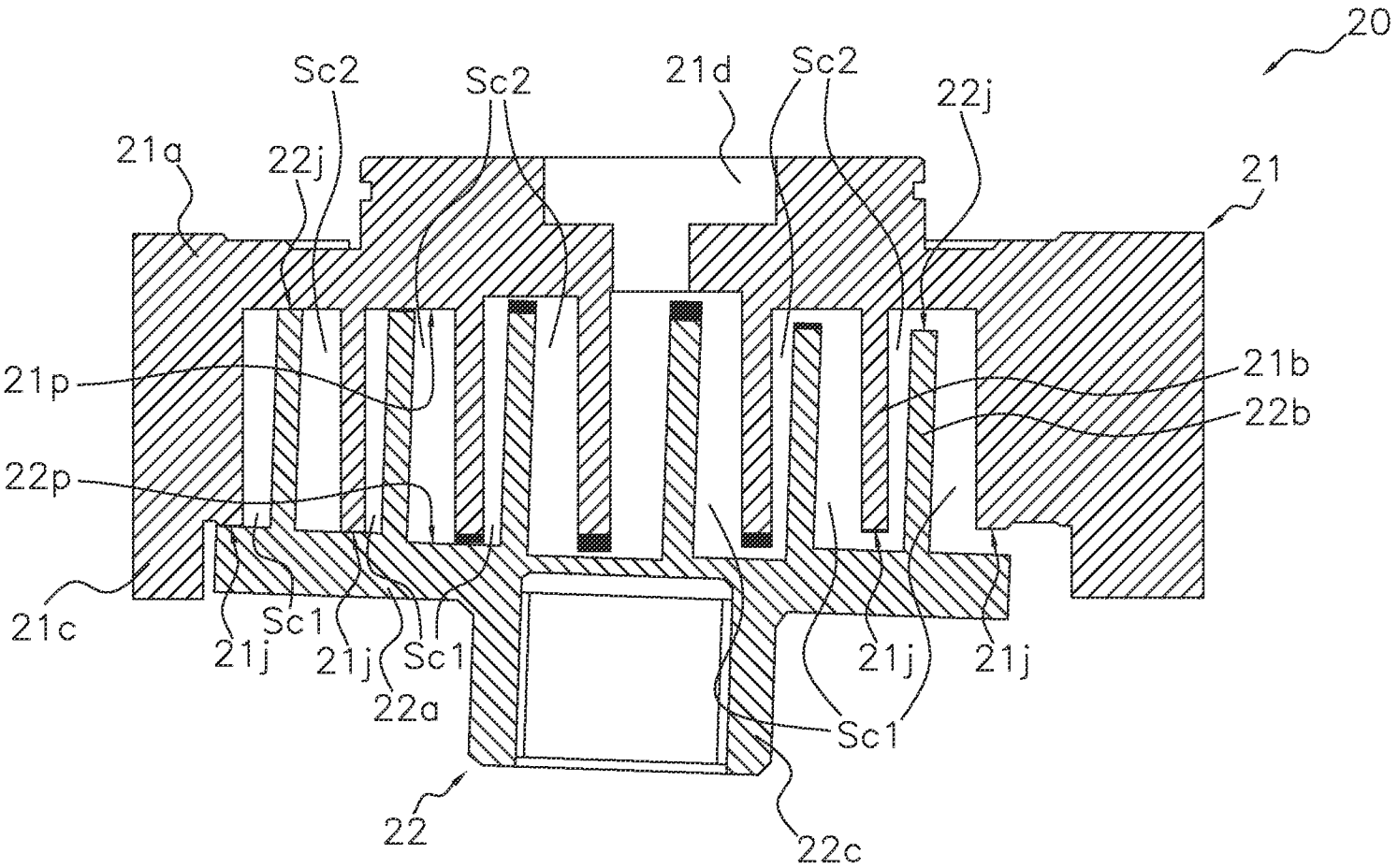
FIG. 21 is a longitudinal sectional view of the fixed scroll 21 and the movable scroll 22 according to Modification D.
Figure 22:
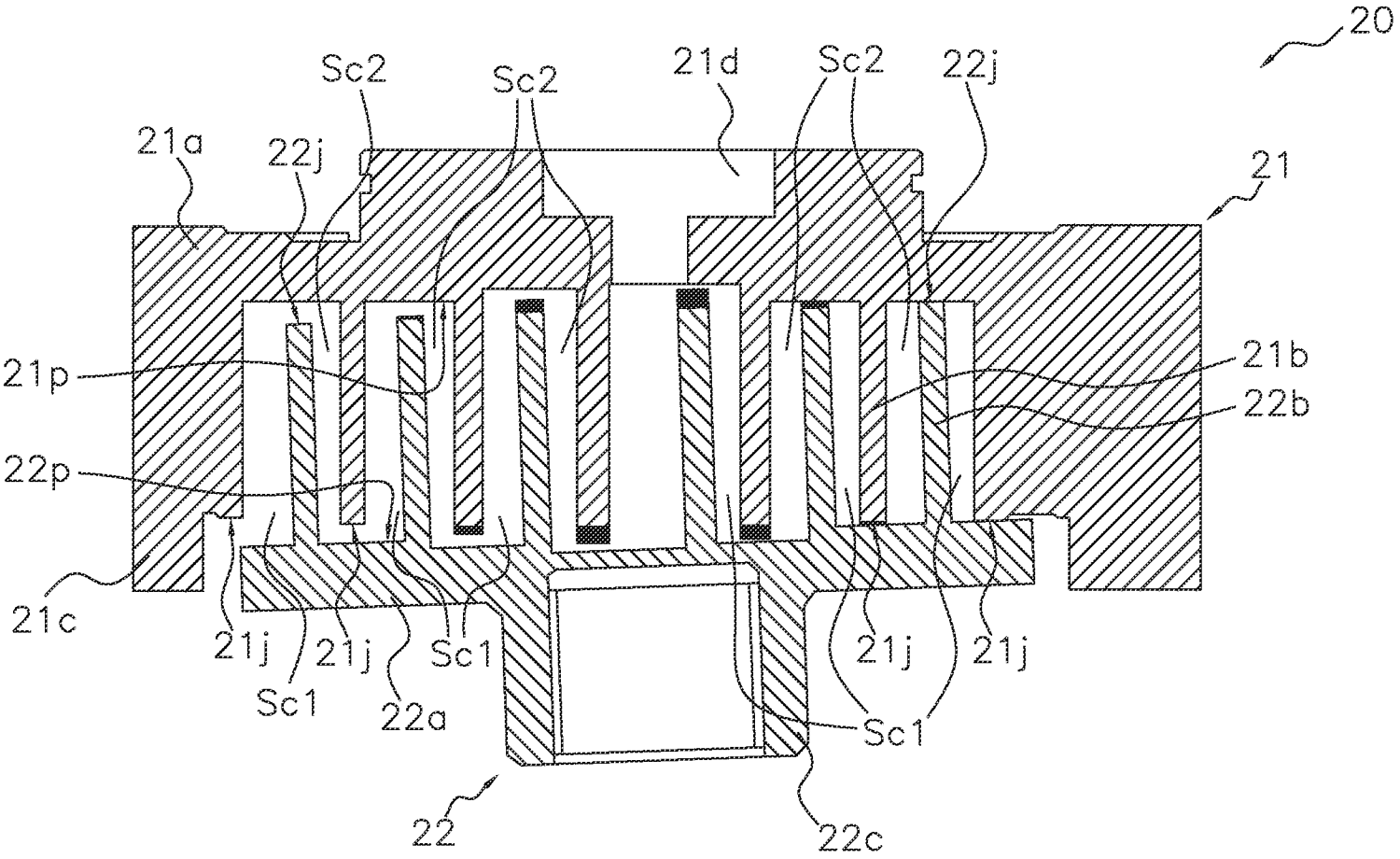
FIG. 22 is a longitudinal sectional view of the fixed scroll 21 and the movable scroll 22 according to Modification D.

Next, a state when the movable scroll 22 is inclined with respect to the fixed scroll 21 will be described with reference to FIGS. 21 and 22. The fixed scroll 21 and the movable scroll 22 illustrated in FIGS. 21 and 22 are sectional views taken along line E-E in FIG. 18 and line F-F in FIG. 19. FIGS. 21 and 22 illustrate a state in which the movable scroll 22 is inclined. FIG. 22 illustrates a state in which the movable scroll 22 has revolved by 180° from the state illustrated in FIG. 21. FIGS. 21 and 22 illustrate a state in which deformation of the fixed scroll 21 and the movable scroll 22 occurs. The inclination and deformation of the movable scroll 22 illustrated in FIGS. 21 and 22 are exaggerated from an actual state. In FIGS. 21 and 22, an increase in the fixed-side dimension and the movable-side dimension due to the deformation of the fixed scroll 21 and the movable scroll 22 is indicated by a filled region.

In the present modification, as in the embodiment, the fixed-side dimension and the movable-side dimension are set such that, when the movable scroll 22 is inclined with respect to the fixed scroll 21, the fixed-side first region 21*j* included in the distal end surface of the fixed-side wrap 21*b* receives a force that presses the movable scroll 22 against the fixed scroll 21. Specifically, the height positions of the main surfaces 21*p* and 22*p* of the fixed-side end plate 21*a* and the movable-side end plate 22*a* are adjusted such that the fixed-side first region 21*j* receive the pressing force from the main surface 22*p* of the movable-side end plate 22*a*.

As a result, as illustrated in FIGS. 21 and 22, while the movable scroll 22 is revolving, the distal end surface of the fixed-side wrap 21*b* is in contact with the main surface 22*p* of the movable-side end plate 22*a* partially in a part between 0.0 turns and 2.0 turns from the fixed-side reference point 21*f* toward the winding start 21*s* of the fixed-side wrap 21*b*. In FIG. 21, in the fixed-side first region 21*j*, a distal end surface of a part between 0.0 turns and 0.5 turns and a distal end surface of a part between 1.0 turns and 1.5 turns from the fixed-side reference point 21*f* toward the winding start 21*s* of the fixed-side wrap 21*b* are in contact with the main surface 22*p* of the movable-side end plate 22*a*. In FIG. 22, in the fixed-side first region 21*j*, a distal end surface of a part between 0.5 turns and 1.0 turns and a distal end surface of a part between 1.5 turns and 2.0 turns from the fixed-side reference point 21*f* toward the winding start 21*s* of the fixed-side wrap 21*b* are in contact with the main surface 22*p* of the movable-side end plate 22*a*.

In the present modification, as in the embodiment, by sufficiently securing the region (the fixed-side first region 21*j*) of the distal end surface of the fixed-side wrap 21*b* on which the pressure due to the thrust load acts, wear of the fixed scroll 21 and the movable scroll 22 is suppressed, and a decrease in efficiency of the scroll compressor 100 is suppressed.

The fixed-side first region 21*j* is formed near the outermost periphery of the fixed-side wrap 21*b*. Therefore, the amount of the refrigerant leaking from the compression chamber Sc on the peripheral edge (outer side) into the first space S1 is reduced and, thus, a decrease in efficiency of the scroll compressor 100 is suppressed.

Modification C is applicable to the present modification.

(6-5) Modification E

In Modification D, the fixed-side dimension and the movable-side dimension may also be set such that, when deformation of the fixed scroll 21 and the movable scroll 22 occurs, the movable-side second region 22*k* included in the distal end surface of the movable-side wrap 22*b* does not receive a force that presses the movable scroll 22 against the fixed scroll 21. Specifically, the height positions of the main surfaces 21*p* and 22*p* of the fixed-side end plate 21*a* and the movable-side end plate 22*a* are adjusted such that the movable-side second region 22*k* does not receive the pressing force from the main surface 21*p* of the fixed-side end plate 21*a*.

In the present modification, the movable-side second region 22*k* is a distal end surface of a part between 0.0 turns and 1.0 turns from the movable-side reference point 22*f*. A definition of the movable-side reference point 22*f* is the same as that of the embodiment or Modification B. In FIG. 19, the movable-side second region 22*k* is indicated by a hatched region.

Figure 23:
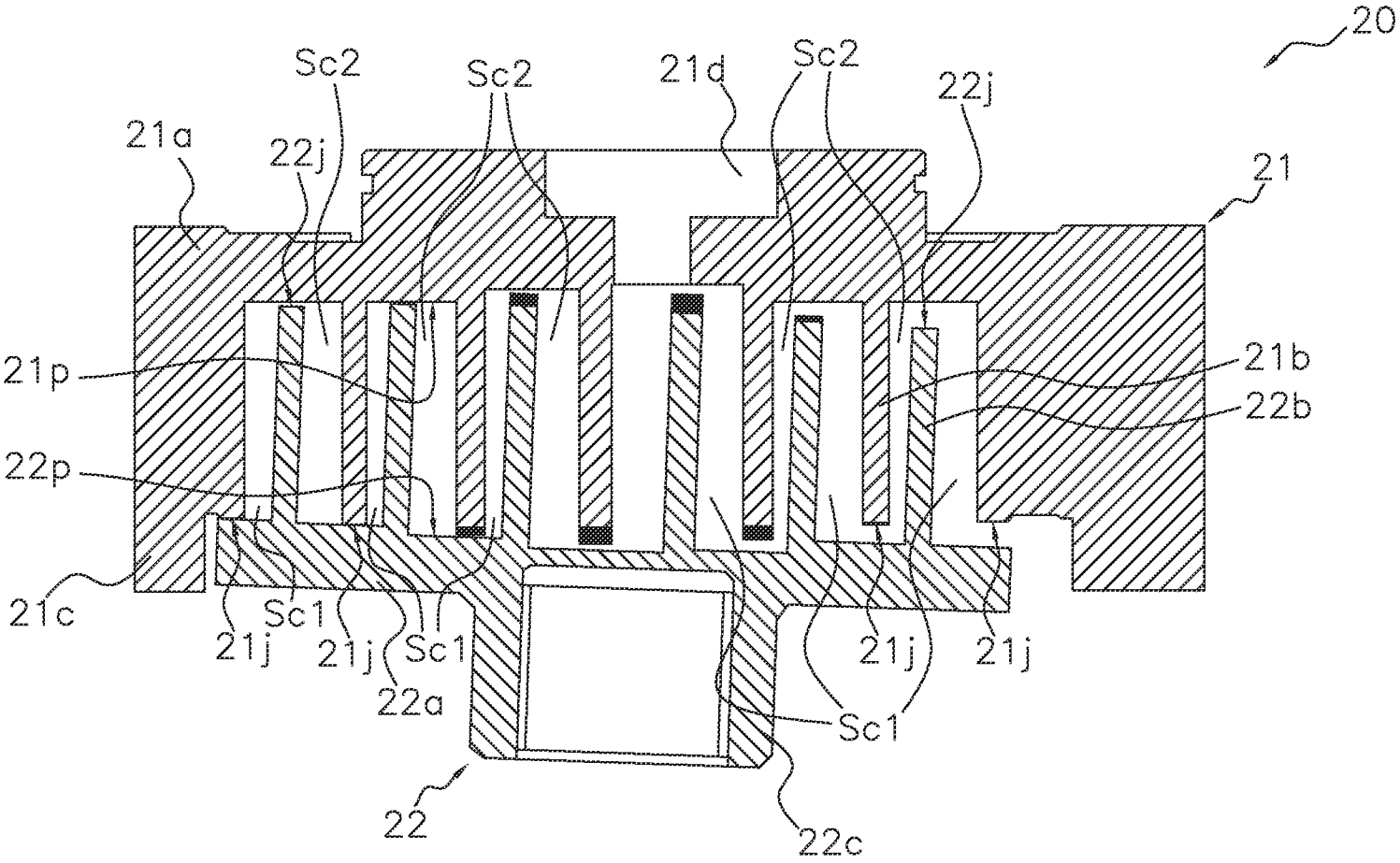
FIG. 23 is a longitudinal sectional view of the fixed scroll 21 and the movable scroll 22 according to Modification E.
Figure 24:
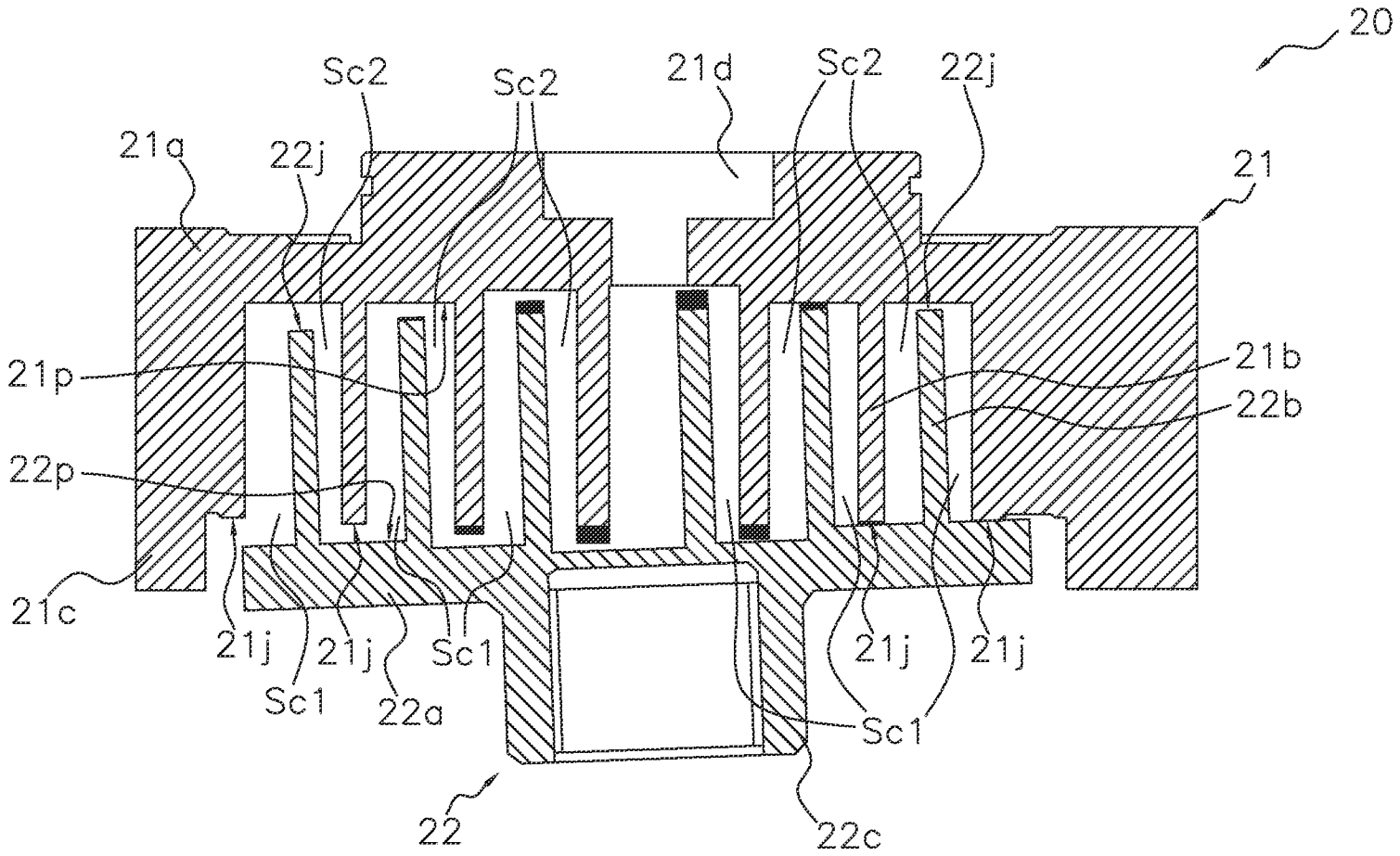
FIG. 24 is a longitudinal sectional view of the fixed scroll 21 and the movable scroll 22 according to Modification E.

Next, a state when the movable scroll 22 is inclined with respect to the fixed scroll 21 will be described with reference to FIGS. 23 and 24. The fixed scroll 21 and the movable scroll 22 illustrated in FIGS. 23 and 24 are sectional views taken along line E-E in FIG. 18 and line F-F in FIG. 19. FIGS. 23 and 24 illustrate a state in which the movable scroll 22 is inclined. FIG. 24 illustrates a state in which the movable scroll 22 has revolved by 180° from the state illustrated in FIG. 23. FIGS. 23 and 24 illustrate a state in which deformation of the fixed scroll 21 and the movable scroll 22 occurs. The inclination and deformation of the movable scroll 22 illustrated in FIGS. 23 and 24 are exaggerated from an actual state. In FIGS. 23 and 24, an increase in the fixed-side dimension and the movable-side dimension due to the deformation of the fixed scroll 21 and the movable scroll 22 is indicated by a filled region.

In the present modification, the height positions of the main surfaces 21*p* and 22*p* of the fixed-side end plate 21*a* and the movable-side end plate 22*a* are adjusted such that the movable-side second region 22*k* does not receive the pressing force from the main surface 21*p* of the fixed-side end plate 21*a*.

As a result, as illustrated in FIGS. 23 and 24, while the movable scroll 22 is revolving, the distal end surface of the movable-side wrap 22*b* is not in contact with the main surface 21*p* of the fixed-side end plate 21*a* partially in a part between 0.0 turns and 1.0 turns from the movable-side reference point 22*f* toward the winding start 22*s* of the movable-side wrap 22*b*. Specifically, while the movable scroll 22 is revolving, the main surface 21*p* of the fixed-side end plate 21*a* is not in contact with the movable-side second region 22*k*.

In the present modification, as in Modification A, in a state where the movable scroll 22 is inclined and the fixed scroll 21 and the movable scroll 22 are deformed, the movable scroll 22 does not receive the thrust load in the movable-side second region 22*k*. Thus, since the movable scroll 22 does not receive the thrust load, the fixed scroll 21 can effectively receive the thrust load in the fixed-side first region 21*j*. Accordingly, wear of the fixed scroll 21 and the movable scroll 22 is suppressed, and a decrease in efficiency of the scroll compressor 100 is suppressed.

CONCLUSION

Although the embodiment of the present disclosure has been described above, it will be understood that various changes in form and details can be made without departing from the spirit and scope of the present disclosure described in claims.

The invention claimed is:

1. A scroll compressor comprising:

a fixed scroll including a fixed-side end plate and a fixed-side wrap; and a movable scroll including a movable-side end plate and a movable-side wrap, the fixed-side wrap extending, from a main surface of the fixed-side end plate, along a first direction with a fixed-side dimension, the moveable-side wrap extending, from a main surface of the movable-side end plate, along the first direction with a mm able-side dimension, the main surface of the movable-side end plate facing the main surface of the fixed-side end plate, the fixed scroll and the movable scroll forming a first compression chamber surrounded by an inner peripheral surface of the fixed-side wrap and an outer peripheral surface of the movable-side wrap and a second compression chamber surrounded by an outer peripheral surface of the fixed-side wrap and an inner peripheral surface of the movable-side wrap, the fixed-side dimension and the movable-side dimension being set such that a fixed-side first region included in a distal end surface of the fixed-side wrap receives a force that presses the movable scroll against the fixed scroll when the movable scroll is inclined with respect to the fixed scroll, and the first compression chamber and the second compression chamber being point-symmetrical when viewed along the first direction, the fixed-side dimension and the movable-side dimension being set such that, when the movable scroll is inclined with respect to the fixed scroll, a movable-side first region included in a distal end surface of the movable-side wrap receives the force that presses the movable scroll against the fixed scroll, the fixed-side first region being a distal end surface of a part between 0.0 turns and 0.5 turns from a fixed-side reference point set in advance and located on an outermost periphery of the fixed-side wrap and a distal end surface of a part between 1.0 turns and 1.5 turns from the fixed-side reference point, and the movable-side first region being a distal end surface of a part between 0.0 turns and 0.5 turns from a movable-side reference point set in advance and located on an outermost periphery of the movable-side wrap and a distal end surface of a part between 1.0 turns and 1.5 turns from the movable-side reference point, the fixed-side dimension and the movable-side dimension being set such that, when deformation of the fixed scroll and the movable scroll occurs, a fixed-side second region included in a distal end surface of the fixed-side wrap does not receive the force that presses the movable scroll against the fixed scroll, and a movable-side second region included in a distal end surface of the movable-side wrap does not receive the force that presses the movable scroll against the fixed scroll, the fixed-side second region being a distal end surface of a part between 0.5 turns and 1.0 turns from the fixed-side reference point, and the movable-side second region being a distal end surface of a part between 0.5 turns and 1.0 turns from the movable-side reference point.

2. A scroll compressor comprising:

a fixed scroll including a fixed-side end plate and a fixed-side wrap; and a movable scroll including a movable-side end plate and a movable-side wrap, the fixed-side wrap extending, from a main surface of the fixed-side end plate, along a first direction with a fixed-side dimension, the movable-side wrap extending, from a main surface of the movable-side end plate, along the first direction with a movable-side dimension, the main surface of the movable-side end plate facing the main surface of the fixed-side end plate, the fixed scroll and the movable scroll forming a first compression chamber surrounded by an inner peripheral surface of the fixed-side wrap and an outer peripheral surface of the movable-side wrap and a second compression chamber surrounded by an outer peripheral surface of the fixed-side wrap and an inner peripheral surface of the movable-side wrap, the fixed-side dimension and the movable-side dimension being set such that a fixed-side first region included in a distal end surface of the fixed-side wrap receives a force that presses the movable scroll against the fixed scroll when the movable scroll is inclined with respect to the fixed scroll, and the fixed-side first region including a distal end surface of a part between 0.0 turns and 0.5 turns from a fixed-side reference point set in advance and located on an outermost periphery of the fixed-side wrap and a distal end surface of a part between 1.0 turns and 1.5 turns from the fixed-side reference point, a number of turns of the fixed-side wrap and a number of turns of the movable-side wrap being different from each other, the fixed-side first region is a distal end surface of a part between 0.0 turns and 2.0 turns from the fixed-side reference point, the fixed-side dimension and the movable-side dimension being set such that, when deformation of the fixed scroll and the movable scroll occurs, a movable-side second region included in a distal end surface of the movable-side wrap does not receive the force that presses the movable scroll against the fixed scroll, and the movable-side second region being a distal end surface of a part between 0.0 turns and 1.0 turns from a movable-side reference point set in advance and located on an outermost periphery of the movable-side wrap.

3. The scroll compressor according to claim 2, wherein the deformation of the fixed scroll and the movable scroll is due to at least one of pressure and heat of at least one of the first compression chamber and the second compression chamber.

4. The scroll compressor according to claim 3, wherein the fixed scroll and the movable scroll form the first compression chamber and the second compression chamber at a first time point while the movable scroll is revolving, the fixed-side reference point is at a position in contact with a side surface of the mm able-side wrap at the first time point, and the movable-side reference point is at a position in contact with a side surface of the fixed-side wrap at the first time point.

5. The scroll compressor according to claim 3, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

6. The scroll compressor according to claim 2, wherein the fixed scroll and the movable scroll form the first compression chamber and the second compression chamber at a first time point while the movable scroll is revolving, the fixed-side reference point is at a position in contact with a side surface of the movable-side wrap at the first time point, and the movable-side reference point is at a position in contact with a side surface of the fixed-side wrap at the first time point.

7. The scroll compressor according to claim 6, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

8. The scroll compressor according to claim 2, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

9. The scroll compressor according to claim 1, wherein the deformation of the fixed scroll and the movable scroll is due to at least one of pressure and heat of at least one of the first compression chamber and the second compression chamber.

10. The scroll compressor according to claim 9, wherein the fixed scroll and the movable scroll form the first compression chamber and the second compression chamber at a first time point while the movable scroll is revolving, the fixed-side reference point is at a position in contact with a side surface of the movable-side wrap at the first time point, and the movable-side reference point is at a position in contact with a side surface of the fixed-side wrap at the first time point.

11. The scroll compressor according to claim 9, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

12. The scroll compressor according to claim 1, wherein the fixed scroll and the movable scroll form the first compression chamber and the second compression chamber at a first time point while the movable scroll is revolving, the fixed-side reference point is at a position in contact with a side surface of the movable-side wrap at the first time point, and the movable-side reference point is at a position in contact with a side surface of the fixed-side wrap at the first time point.

13. The scroll compressor according to claim 12, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

14. The scroll compressor according to claim 1, wherein the fixed-side wrap has a fixed-side step formed on a distal end surface of the fixed-side wrap at the outermost periphery of the fixed-side wrap, the movable-side wrap has a movable-side step formed on a distal end surface of the movable-side wrap at the outermost periphery of the movable-side wrap, the fixed-side reference point is located at the fixed-side step in a direction in which the distal end surface of the fixed-side wrap extends, and the movable-side reference point is located at the movable-side step in a direction in which the distal end surface of the movable-side wrap extends.

* * * * *